US009812107B2

(12) United States Patent
Butera

(10) Patent No.: US 9,812,107 B2
(45) Date of Patent: Nov. 7, 2017

(54) ERGONOMIC ELECTRONIC MUSICAL INSTRUMENT WITH PSEUDO-STRINGS

(71) Applicant: Artiphon, LLC, Nashville, TN (US)

(72) Inventor: Michael V. Butera, Nashville, TN (US)

(73) Assignee: Artiphon, Inc., Nashville, TN (US)

( * ) Notice: Subject to any disclaimer, the term of this patent is extended or adjusted under 35 U.S.C. 154(b) by 0 days.

(21) Appl. No.: 15/042,705

(22) Filed: Feb. 12, 2016

(65) Prior Publication Data

US 2016/0163298 A1 Jun. 9, 2016

Related U.S. Application Data

(63) Continuation-in-part of application No. 14/306,818, filed on Jun. 17, 2014, now abandoned, which is a continuation of application No. 13/737,692, filed on Jan. 9, 2013, now Pat. No. 8,796,529.

(60) Provisional application No. 61/584,862, filed on Jan. 10, 2012.

(51) Int. Cl.

| | |
|---|---|
| ***G10H 1/32*** | (2006.01) |
| ***G10H 1/34*** | (2006.01) |
| ***G10H 1/00*** | (2006.01) |

(52) U.S. Cl.

CPC ..... *G10H 1/342* (2013.01); *G10H 1/0066* (2013.01); *G10H 2210/225* (2013.01); *G10H 2220/096* (2013.01); *G10H 2220/241* (2013.01); *G10H 2220/301* (2013.01); *G10H 2220/391* (2013.01); *G10H 2220/395* (2013.01); *G10H 2230/015* (2013.01); *G10H 2230/075* (2013.01)

(58) Field of Classification Search

CPC ..... G10H 1/32; G10H 1/342

USPC ..... 84/670

See application file for complete search history.

(56) References Cited

U.S. PATENT DOCUMENTS

| | | | | | |
|---|---|---|---|---|---|
| 3,353,435 | A * | 11/1967 | Schmoyer | G09B 15/08 | 84/478 |
| 3,555,166 | A * | 1/1971 | Gasser | G10H 1/342 | 84/600 |
| 4,078,464 | A * | 3/1978 | Sugiyama | G10H 1/342 | 84/744 |
| 4,085,647 | A * | 4/1978 | Adachi | G10H 5/002 | 84/673 |
| 4,177,705 | A * | 12/1979 | Evangelista | G10H 1/342 | 84/720 |
| 4,311,078 | A * | 1/1982 | Falgares | G10D 3/06 | 84/267 |

(Continued)

OTHER PUBLICATIONS

Stefan Joubert https://www.youtube.com/watch?v=TTdA6VJDCsl (viewed online on Aug. 19, 2016).*

*Primary Examiner* — David Warren

(57) ABSTRACT

An ergonomic, portable, electronic, string-like instrument that utilizes a string-like interface. The string-like interface is tactile for sightless playability and capable of advanced input such as force and pressure sensitivity. The string-like interface functions to select a note, trigger a selected note, select and play a note on the instrument or an external peripheral. The instrument is played using the techniques of multiple stringed instruments and the ergonomics allow the user to hold and handle the device consistent with playing techniques familiar to musicians of multiple instruments. It is internally or externally powered and connects directly to industry-standard musical hardware such as MIDI devices, amplifiers and multi-track recorders.

17 Claims, 20 Drawing Sheets

(56) References Cited

U.S. PATENT DOCUMENTS 4,336,734 A * 6/1982 Polson ..... G10H 1/057 84/646
4,339,979 A * 7/1982 Norman ..... G10H 1/057 84/627
RE31,019 E * 8/1982 Evangelista ..... G10H 1/342 84/702
4,384,503 A * 5/1983 Gunn ..... G10H 1/0016 84/653
4,570,521 A * 2/1986 Fox ..... G10H 1/342 200/5 A
4,750,397 A * 6/1988 Ashworth-Jones .... G10H 3/185 84/173
4,794,838 A * 1/1989 Corrigau, III ..... G10H 1/24 338/69
4,919,031 A * 4/1990 Matsumoto ..... G10H 1/342 84/601
4,974,486 A * 12/1990 Wallace ..... G10H 1/342 446/408
5,005,460 A * 4/1991 Suzuki ..... G06F 3/014 84/600
5,025,696 A * 6/1991 Brown ..... G10D 3/06 84/314 R
5,074,182 A * 12/1991 Capps ..... G10H 1/361 84/600
5,085,115 A * 2/1992 Schlink ..... G10H 1/32 84/310
5,095,799 A * 3/1992 Wallace ..... G10H 1/342 446/408
5,121,668 A * 6/1992 Segan ..... G10H 1/342 84/646
5,726,372 A * 3/1998 Eventoff ..... G10H 1/0008 84/477 R
5,726,374 A * 3/1998 Vandervoort ..... G10H 1/28 84/638
5,739,455 A * 4/1998 Poon ..... G10H 1/0083 84/478
5,773,742 A * 6/1998 Eventoff ..... G10H 1/0008 84/477 R
5,824,924 A * 10/1998 Agostino ..... G10H 3/18 84/291
D410,024 S * 5/1999 Eventoff ..... D17/14
5,902,949 A * 5/1999 Mohrbacher ..... G10H 1/0008 84/609
6,777,608 B1 * 8/2004 Redding ..... G10H 1/342 84/746
7,220,912 B2 * 5/2007 Juszkiewicz ..... G10H 1/0058 84/728
7,230,174 B1 * 6/2007 Wilson ..... G10D 1/085 84/267
7,435,178 B1 * 10/2008 Tam ..... A63F 13/06 273/148 B
7,514,615 B2 * 4/2009 Ribbecke ..... G10D 1/02 84/291
7,521,619 B2 * 4/2009 Salter ..... G09B 15/00 84/470 R
7,598,449 B2 * 10/2009 Sullivan ..... G10H 1/342 84/615
7,754,961 B1 * 7/2010 Yang ..... A63F 13/06 273/148 B
7,897,866 B2 * 3/2011 Sullivan ..... G10H 1/342 84/440
8,439,733 B2 * 5/2013 Kay ..... A63F 13/10 463/7
8,550,908 B2 * 10/2013 Booth ..... A63F 13/10 463/30
D707,104 S * 6/2014 Rand ..... D8/348
8,796,529 B2 * 8/2014 Butera ..... G10H 1/32 84/647
8,847,051 B2 * 9/2014 Hanks ..... G10H 1/342 84/423 R
8,878,042 B2 * 11/2014 Van Wagoner ..... G10G 1/02 84/293
2007/0169615 A1 * 7/2007 Chidlaw ..... G10H 1/0091 84/723
2009/0100992 A1 * 4/2009 Elion ..... G10H 1/0066 84/646
2012/0297961 A1 * 11/2012 Shim ..... G10H 1/34 84/645
2012/0297962 A1 * 11/2012 O'Donnell ..... G10H 1/34 84/645
2013/0180385 A1 * 7/2013 Hamilton ..... G10H 1/0016 84/603
2014/0283670 A1 * 9/2014 Eventoff ..... G10H 3/00 84/723
2016/0163298 A1 * 6/2016 Butera ..... G10H 1/342 84/615

* cited by examiner

ERGONOMIC ELECTRONIC MUSICAL INSTRUMENT WITH PSEUDO-STRINGS

CROSS-REFERENCE TO RELATED APPLICATION

The present application is a continuation-in-part of U.S. application Ser. No. 14/306,818, filed Jun. 17, 2014, which is a continuation of U.S. application Ser. No. 13/737,692, filed Jan. 9, 2013, which claims priority benefit of U.S. Provisional Application No. 61/584,862, filed Jan. 10, 2012 and which are herein incorporated by reference in their entirety.

BACKGROUND OF THE INVENTION

Software for making music and interfaces to interact with such software has advanced in dramatic ways over the past thirty years. Computers, mobile devices, and other electronic devices continue to gain popularity as means for creating music, recording it, and arranging musical parts into larger projects. However, the selection of hardware options available to musicians as means to control software continues to be significantly limited. Whether in terms of expressive potential, connectivity limitations, or ergonomic forms, the category of hardware controllers demands constant innovation to keep pace with the potential capabilities of new software.

Furthermore, with the advent of non-linear software for electronic performance and sound manipulation, hardware interfaces that are locked into one configuration for triggering events are not tapping the full potential of the software that they control. It is no longer the case that sounds are generated by an instrument or synthesizer and then filtered through external effects; in many current electronic instruments and software programs, sound generation and effects processing are often accomplished in the same device. Virtual controls such as multi-axis grids and sliders require new hardware devices that are not mapped merely according to traditional formats of keys and frets. Next-generation instruments need to be highly adaptable to support these new software capabilities, both in terms of hardware flexibility and software configurability.

Touch-screen computers and associated musical software have greatly expanded the ways that sounds can be created and processed by a user, specifically in the case of non-linear sequencing and multi-axis grids for effects triggering. However, the lack of tactile input in these touch screen computers requires that the musician must always look at the screen to know where to press his or her fingers. This lack of blind tactility is a significant hindrance to a user. Additionally, such screens generally lack force-sensitivity, accomplishing an approximation of force-sensitivity only through accelerometers and gyroscopes rather than directly from user touch points. Developing this third dimension of tactile input is key for advanced musical expression.

Traditional stringed instruments like the guitar, violin, banjo, and bass suffer from some notable limitations, largely because they rely on the vibration of strings and the resonance of those vibrations through the body of the instrument to which they are attached. These strings are prone to breaking, going out of tune, losing tonal quality as they age, and other shortcomings. Traditional stringed instruments also require constant adjustment in order to stay in tune. Additionally, to change to a new tuning requires changing the tension of individual strings, replacing strings (to accommodate the new string tension), or a new "setup" (precise adjustments to the bridge and other components of the instrument). The strings also rely on mechanical systems like tuning pegs and bridges that require constant adjustment and are prone to failure. The resonant bodies of these instruments can fall victim to breaking due to their fragile structure, warping or becoming distorted from environmental factors like humidity. These limitations have been noted elsewhere, but significant opportunities remain to replace such strings with robust electronic alternatives.

Multiple interfaces have been developed to attempt to emulate string-like playability on electronic (especially MIDI) instruments. Some incorporate buttons or other sensors underneath traditional frets or strings on a fingerboard. These suffer from the difficulties of detecting string bends, pitch differences in strings, and uncomfortably require the user to press the string directly down onto the sensor. Others, such as Roland MIDI guitars, use electronic pickups to detect the vibration of traditional strings and then parse those vibrations into individual notes. The continuing difficulty of this solution is that it requires advanced signal processing to extract the intended notes from the large amount of harmonic noise present on a physical string interface. Other instruments have foregone strings altogether, using button triggers at each fret to synthesize the interface of strings. These behave more like fretted keyboards than stringed instruments, lack the ergonomics and linear finger sliding of physical strings, and require the user to learn a new playing technique to adapt to the button feel.

Another difficulty of such button interfaces is in the method of strumming, bowing, or other string-like triggering required to operate them. Some devices are operated through short string interfaces for the triggering hand that are then measured by piezo, string tension or other pickups to determine attack and sustain. This requires two different techniques for playing such an instrument: one for the notes on buttons and the other for strumming/triggering. Other devices use mechanical triggers (e.g., Guitar Hero devices) which flip back and forth as an inverted guitar "pick." These devices have very limited expressive potential. Still others utilize touch-screens, which may be embedded into the device (e.g., Kitara digital guitars) or exist on a tablet screen which is then incorporated into the instrument (e.g., Behringer iAxe guitars). Touch screens carry the same limitations listed above for tablet computers. They are inherently non-tactile, requiring the user to look at the screen to determine finger placement. Touch screens also lack force and pressure-sensitivity, except through workarounds such as accelerometers, which limits the subtle musicality of triggering notes as would be available on a traditional stringed instrument. There is still a need for a string-like electronic instrument with a natural, expressive, and flexible strumming option in one hardware controller.

While there have been attempts to create more varieties of instrument-like hardware controllers for making electronic music—MIDI guitars, electronic drum kits, and the like—they have suffered from a lack of well-designed ergonomic interfaces that allow for alternative musical techniques. When choosing an electronic instrument, a musician must generally choose between a few of these types, each of which are singular in their playable technique. By being limited to dominant non-electronic instrument forms (e.g., keyboards, drums, guitars), these devices have inherent musical limitations. While these instruments allow for retuning (changing which notes are triggered by which inputs), they still require a traditional playing technique to generate the appropriate signal that is then converted into a note. For example, a user may be able to shift the tuning of a synthetic guitar's strings up or down, but a musician is still expected to play it like a traditional guitar. In other words, if someone buys a MIDI guitar, he or she will emulate traditional guitar-like techniques while playing it. He or she will not be able, for instance, to play the guitar like an upright bass or violin. Electronic instruments are generally intended to be played with a very particular, rather than a flexible and adaptable, technique. There is a need for electronic instruments that can be adapted to different playing techniques.

Many digital instruments employ a key-type interface, where each key represents a single semitone in a musical scale (for example, the standard Western scale consists of 12 notes dividing up a single octave). Standard key interfaces are often capable of detecting velocity or continuous pressure within that note location. Digital instruments capable of string-like playability have mostly employed this same interface format, which is functional for fretted playability (such as a guitar) but not fretless (like the violin family of instruments). Fretless stringed instruments require that the note location be continuous; it is up to the player to determine the position of semitones within octaves, and it is possible to play out of tune or in alternate intonations (such as just intonation, equal temperament, or instrument-specific intonations such as the Pelog for gamelans). In short, the multi-instrument requires a continuous sensing interface that is capable of switching between fretted (key-like) and fretless (untuned) playing styles.

Electronic instrument body styles are also designed for a limited number of ergonomic playing positions and triggering techniques. For a musician who wishes to use multiple techniques such as bowing a violin or cello, fading in notes or pitches as on a pedal steel guitar, or switching between fretted and non-fretted necks during a performance, there are no solutions currently available in a single device. Skill and familiarity that musicians have already cultivated with their instruments of choice are often non-transferable to electronic music making.

Alternatively, electronic instruments have been devised with creative, non-traditional interfaces. These require the musician to learn a new playing technique that is unique to that specific device, and in many cases, therefore, learn a skill that is non-transferable to other devices. Because many musicians have been taught on traditional instruments, this learning curve can be significant. Conversely, for a musician who learns on these non-traditional devices, it is difficult to translate that musical skill onto other instruments, of traditional form or otherwise. A student of the Theremin, for instance, is not likely to be able to play a violin on the first try. In short, while current electronic instruments may or may not be ergonomic, they fail to resemble traditional instrument ergonomics enough to enable translation of skills between them.

Even among traditional instruments, this same proprietary skill isolation holds true. Most instrumentalists are able to learn and play on particular instruments (e.g., violin, snare drum, electronic keyboard) rather than whole categories (e.g., strings, drums, keys) at once. There is a lack of instruments available to enable students to learn multiple techniques in a single interface. These techniques include finger positions for alternate tunings, triggering techniques (such as strumming, plucking, picking, bowing, slapping, tapping, etc.), body-holding positions (on the lap, on the leg, on the chest, on the shoulder, upright, tabletop, etc.), and responsiveness to differences, in the instrument's sensitivity and translation of touch input to sound output (when tapping a string, whether it resounds immediately or gradually fades in requires different skills on the part of the musician) (collectively referred to herein as "tactile user input"). What is needed is an instrument capable of being played in multiple ways. It should share the fundamental basics with multiple instruments having different techniques and playing styles and allow a user to switch both the virtual instrument and the handling style of the physical instrument.

Additionally, traditional and current electronic stringed instruments do not capture sound in ways that meet the artistic goals of many musicians and producers. Music that is performed live must be recorded accurately, processed to produce the desired qualities, and often mixed with other recordings (musical, vocal, or otherwise) to create a finished product. This generally requires multiple stages, many separate pieces of equipment, special facilities like recording booths, and a broad variety of skills. With the widespread adoption of DAWs (Digital Audio Workstations) in laptop and desktop computers, musicians and producers now have the opportunity to consolidate much of this production into a single machine. The recent advent of multi-track recording on mobile devices extends this functionality even further. However, the primary distinction between instrument and recorder still exists for the majority of instruments. While it is common for electronic musical keyboards to have recording capabilities built-in, most other electronic instruments must be connected in various ways to other equipment to enable recording. When a producer desires multiple instruments to be used on the same track, he or she must connect and play each instrument separately. What is needed is a single electronic instrument that can enable the musician to perform, record, mix and play back these multiple performances internally.

In order to fill each of these needs described above, an electronic instrument is needed which (1) may interface with multiple types of software, (2) has tactile pseudo-strings, (3) replaces strings with pseudo-strings, but maintains a natural, expressive string-like user interface, (4) shares ergonomics with various stringed instruments, (5) allows for multiple playing techniques and (5) allows a user to switch between instrument configurations, both in playing technique and sound output. Additionally, the instrument may allow a user to perform, record, mix and play back performances.

SUMMARY OF THE INVENTION

The musical device ("device", "instrument" or "multi-instrument" throughout this document) is an ergonomic electronic string-like multi-instrument. It has a pseudo-string interface that is tactile for sightless playability, and is capable of advanced input such as force sensitivity. The pseudo-strings can function in multiple ways: to select a note (i.e., as a fingerboard), to trigger a selected note (i.e., as a strum section), to select and play a note, or as a controller for an external device. Its physical form enables multiple holding positions and playing techniques familiar to musicians of various stringed instruments. Its electronic configurability of inputs suits multiple playing techniques, both traditional (guitar, violin, etc.) and non-traditional (e.g., the fingerboard configured as a triggering matrix rather than strings). It is fully portable, is internally or externally powered, and connects directly to industry-standard musical hardware such as MIDI devices, amplifiers, and multi-track recorders. The instrument may be configured to record and mix performances played on the instrument. A mobile device may be incorporated onto or into the instrument to extend its musical inputs, sound synthesis, and modulation capabilities. These advanced functions can also be accomplished through embedded electronic systems.

These and other advantages of the invention will be further understood and appreciated by those skilled in the art by reference to the following written specifications, claims and appended drawings.

DETAILED DESCRIPTION

Figure 1:
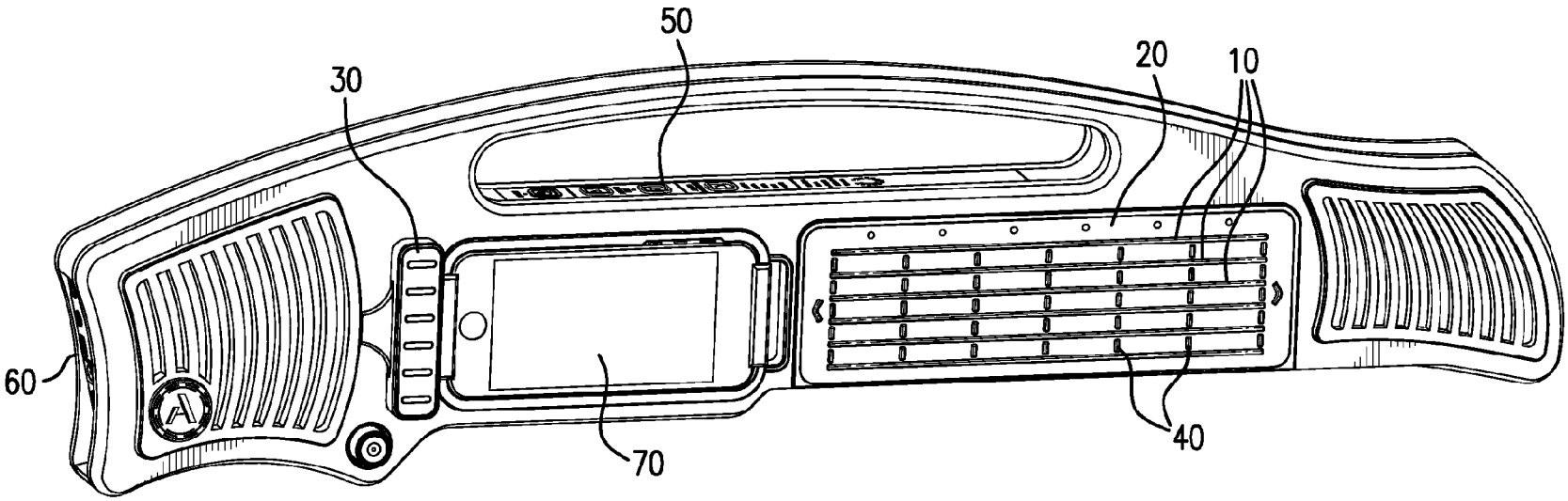
FIG. 1 is a front view of an embodiment of the instrument.

The following list of defined terms is not intended to be limiting or comprehensive but merely provides a quick reference tool for understanding the invention. Other defined terms are capitalized in other sections of this document where they are used. Capitalized terms shall include all variants, and singular and/or plural versions of the terms used herein.

"External Peripheral" means a Peripheral that communicates with the instrument wirelessly or using wires, but is not permanently attached to or integrated into the instrument.

"Fingerboard" means that portion of the instrument which is used to direct the instrument to a particular musical note.

"Fret" on a traditional stringed instrument is a raised portion extending across a fingerboard to divide the fingerboard into segments representing different musical intervals and, in the context of the instrument, a Fret means the divisions between distinct data signal triggering zones, either formed mechanically with a string-sectioning material or electronically using specified touch parameters.

"Internal Peripheral" means a Peripheral that is connected to the instrument wirelessly or using wires and is permanently attached to the instrument.

"MIDI" means Musical instrument Digital Interface protocol.

"OSC" means Open Sound Control protocol.

"Peripheral" means any device or item of hardware or software used in connection with the instrument, and may even be another instrument (including an instrument). By way of example, Peripherals may be, in the case of hardware, a rack unit, mobile device, computer, wireless device, synthesizer, encoder, headphones, microphone, amplifier, speaker, effects unit, live performance mixer, multi-track recorder, gaming system, processor or circuit board and, in the case of software, an interface, computer program, firmware, application, or mobile application.

"Strum Section" means that portion of the instrument, which is used to trigger the instrument, whether by strumming, bowing or touching, to generate a data signal representing the musical note(s) directed by the Fingerboard or independent of the Fingerboard.

"Synthetic Bow" means a Peripheral capable of detecting movements in three-dimensional space through gyroscopes and accelerometers and communicating those movements to the instrument.

It is to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

There exists a need for more expressive electronic musical instruments, particularly those that emulate strings and related playing techniques. The instrument disclosed herein satisfies this need through an integration of previously distinct components as well as novel development and adaptation of several new components. The instrument comprises a universal string-like electronic instrument capable of being played in multiple positions and with multiple triggering techniques. Its distinct innovation is the ability to be played in a variety of ways that are similar to many traditional and non-traditional stringed musical instruments. Its features are listed here, and more details of embodiment options are discussed below.

As shown in FIG. 1, the instrument comprises tactile pseudo-strings 10 capable of triggering electronic music data signals, for instance MIDI. These pseudo-strings may comprise string-like raised lines on a Fingerboard 20 and a Strum Section 30 to enable sightless playability familiar to stringed-instrument musicians. The instrument may also comprise raised or indented Frets 40 to indicate a place to trigger a particular note through a user's tactile sense or by sight. The instrument may also comprise a separate Strum Section 30 configured to trigger notes when touched, or configured to trigger its own separate and distinct musical events unrelated to the Fingerboard 20. When the Strum Section 30 is configured separately, the instrument can be used to perform two different virtual instruments at the same time; for instance, a user could use the instrument to play a drum and bass line simultaneously, one on the Fingerboard 20 and the other on the Strum Section 30. In one embodiment, the instrument does not have a physically separate Fingerboard 20 and Strum Section 30.

The body shape of the instrument is designed to be handled in various ergonomic positions appropriate for different playing techniques. The various embodiments shown here all serve the same function: to enable the user to hold and play the instrument in the way that suits his or her body and his or her own preferred musical technique. While most musical instruments are shaped to be held and played in one particular way, this instrument allows for significant versatility because of its unique and universal body shape and size. This design provides utility by allowing a user to emulate multiple musical techniques on a single instrument, which was previously unavailable in the field. The instrument is portable and even its advanced functions can be self-contained within the body of the instrument, allowing for much greater flexibility than with traditional instruments in terms of musical performance, production, and playback.

In conjunction with its versatile body form, the instrument comprises software that is configurable to be played in multiple and distinct ways. It can emulate a variety of traditional stringed instruments that do not have keys such as guitars, violins, and lap steel instruments. Because the instrument is digital, unlike traditional analog instruments, it can also be configured to respond differently than traditional stringed instruments. For example, the instrument's software can change the tuning, responsiveness, and data transmitted by the sensors. In particular configurations, the instrument can be played with a technique more like a drum machine than a stringed instrument. Because of the body form and the firmware configurations, this enables unprecedented customization of the instrument to suit a user's unique styles and preferences.

After a user determines how he or she will hold the instrument and how the various data signals will be translated into sound, the instrument comprises multiple methods of enabling sound to be produced. These methods of synthesizing sound can be achieved internally and externally to the instrument. Data signals such as MIDI can be communicated via wired or wireless connections to External Peripherals. Data signals can also be used for configuration of the instrument and to communicate with non-musical electronics such as lighting or communications systems. A synthesizer may also be built into the instrument, attached to the instrument, or connected externally to the instrument by way of wires or wireless connectivity such as WiFi or Bluetooth. The instrument may also contain internal audio amplification and transduction (i.e., speakers) to allow the instrument's performance to be heard by the user and nearby listeners. Audio inputs and outputs allow for connection to industry-standard Peripherals.

The instrument can simulate the feeling of physical strings for the user's hand controlling the Fingerboard 20. In one embodiment, the user presses down on the psuedo-string 10 to control the data signals triggered by the instrument. In one embodiment, a user cannot feel the sensors underneath the Fingerboard 20, but only the pseudo-strings 10. This is a significant improvement over current interfaces, such as separated button interfaces, in that the Fingerboard 20 most resembles traditional strings; thus, the user need not learn a new skill to play the instrument. The psuedo-string 10 sensitivity can be tuned to suit the user's preferences. If the user has a particularly hard playing style, the sensitivity can be decreased to accommodate the harder pressure.

Figure 3:
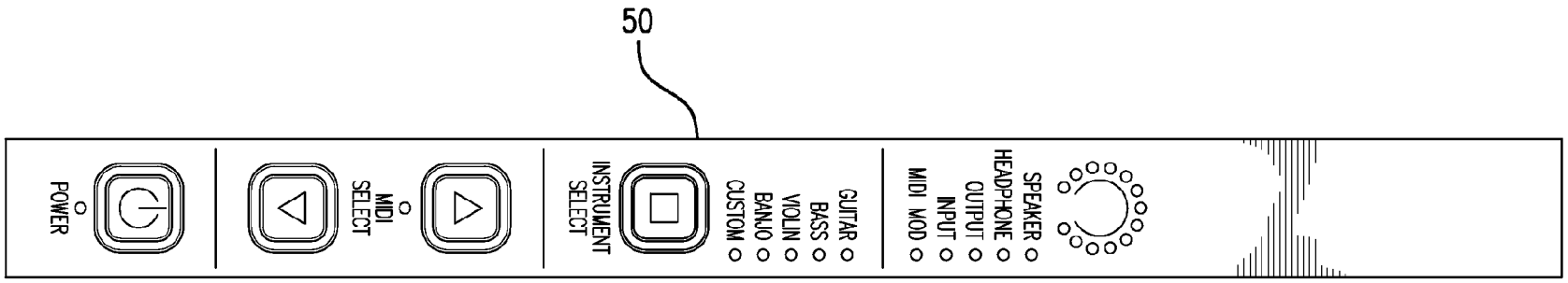
FIG. 3 is a top view of a control or configuration panel.

The instrument can comprise an indefinite number of the pseudo-strings 10 to suit different playing styles and preferences. A standard guitar has six strings, a standard violin has four, and a standard banjo has five. Because of the diverse tunability of each pseudo-string 10 and the responsive configuration of the instrument as a whole, an embodiment of the instrument that has six pseudo-strings 10 can still be played in an alternate form that might normally have fewer strings (for example, as a violin) by either ignoring, disabling or turning off two pseudo-strings 10 during playing or by using them as extended range, as with a five-string viola. Thus, a specific embodiment of the instrument with a particular number of pseudo-strings 10 is capable of supporting multiple instrument modes and playing styles. The thickness of the pseudo-strings 10 on the Fingerboard 20 may be customized to suit the user's preferred traditional instrument (i.e., thicker strings for a traditional bass player than a guitar player). The tuning of the pseudo-strings 10 can also be easily reversed for right or left-hand instrument orientations. Additionally, the octaves represented by the Fingerboard 20 can be switched up and down easily with controls on the body of the instrument, the controls either being located directly adjacent to the Fingerboard or, as shown in FIGS. 1 and 3, on a separate control or configuration panel.

The length of the pseudo-strings 10 does not determine the output pitch, since they contain digital sensors rather than physically vibrating wires. The pitch triggered by each pseudo-string 10 at certain lengths can, therefore, be entirely customized by the user. Additionally, the entire length of the pseudo-string 10 could correspond to a single note, a single octave, or multiple octaves depending on the configuration of the resolution of notes along the pseudo-string 10. This enables dynamic playability that is impossible with traditional instruments, either stringed or keyboard-based varieties, because traditional instruments are fundamentally limited in the number of notes they can trigger. The instrument is capable of changing the resolution of notes along a given pseudo-string 10. By using multiple sensors per note location, it can be configured to have micro-tonal sensitivity. Alternately, by assigning one note per sensor location, the same size Fingerboard 20 can support a wider range of notes. Finally, the ability to interpolate between sensor locations enables an infinite number of note variations along a pseudo-string 10.

In one embodiment, the instrument is capable of changing the resolution of notes along a single pseudo-string in key-like fretted steps or in an untuned, fretless continuum. It employs a pressure-sensitive interface that constantly detects the position and pressure of a finger along the length of string-like features on the fingerboard. Additionally, notes are capable of being triggered via the strum section or, in one embodiment, a bridge feature on the instrument. One embodiment can simulate six strings using pressure and velocity sensors. By combining a strum section that can switch from fretted to fretless with an optional strum section of the interface, the user is able to switch between many different instrument techniques such as strumming fretted strings, strumming fretless strings, bowing fretted strings (by applying continuous pressure on the bridge triggers), dulcimer-like string percussion on the fingerboard, lap-steel-like sliding along the fingerboard, etc.

In one embodiment of the instrument, the Frets 40 can be turned on and off electronically, which allows for on-the-fly instrument customization that would be impossible in traditional instrument construction, where Frets 40 are installed semi-permanently on a Fingerboard 20. This feature allows for the seamless switching between virtual instrument modes allowing the instrument to be a performance-ready multi-instrument. The ability to switch between Fretted and non-Fretted string configuration is a significant improvement over other electronic stringed-instrument designs, some of which are capable of pitch bending along a fingerboard but maintain distinct Fretted zones. The instrument is designed in such a way as to be naturally playable in either mode, depending on the user's preferred technique.

Figure 2:
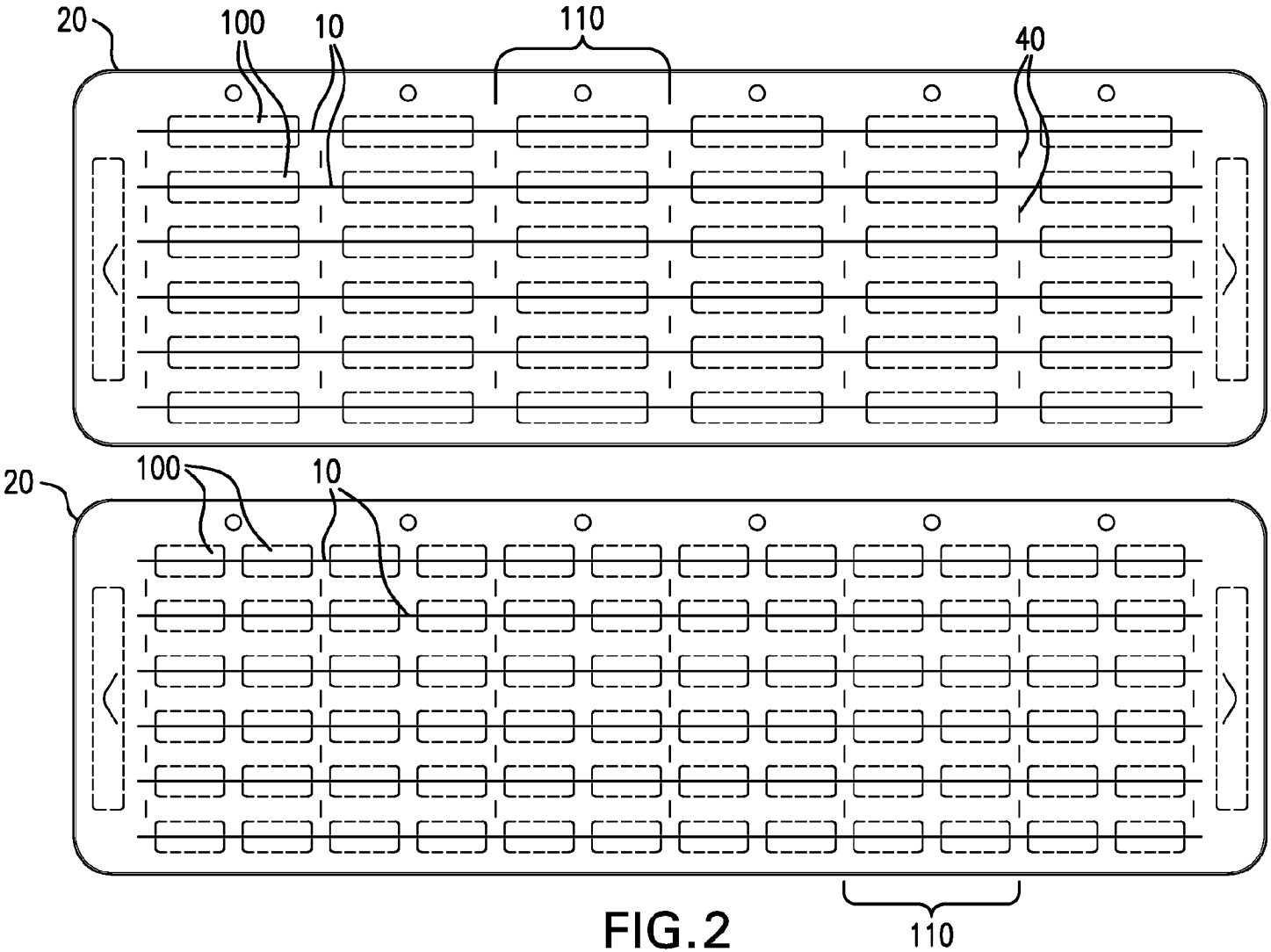
FIG. 2 is a top view of two embodiments of a Fingerboard.

As shown in FIGS. 1 and 2, the instrument comprises a plurality of pseudo-strings 10 to detect user input along a specified plane, such as a linear pseudo-string 10. If a pseudo-string 10 actually contains one or more sensors 100, the sensors 100 can be divided into discreet positions by way of Frets 40 or electronic parameters. For each Fret region 110, there may be one or more sensors 100 to detect input. If more than one sensor 100 is used, advanced musical functions are possible through interpolation or computational comparison between these sensors 100. For example, in one embodiment there are two sensors 100 per Fret 40. A note may be triggered by an initial contact with either of these sensors 100. Subsequent rocking of the finger back and forth between these sensors 100 can be programmed to result in pitch bending or 'vibrato', a common technique used on a Fretless stringed instrument. This functionality allows for a previously impossible hybrid musical technique, as it incorporates the advantage of a Fret 40 (starting a note in-tune) with an advantage of Fretless instruments (minute modulation of pitch and other elements through small movements of the finger along a string).

There are multiple embodiments of the instrument. These embodiments include pseudo-strings 10 having sensors 100 comprised of mechanical switches, capacitive touch-points, resistive touch-points or resistive touch-strips, force-sensing touch-points or force-sensing strips, and other alternatives to touch such as optical sensing points. Mechanical switches and capacitive touch points allow for on/off binary triggering, while resistive and force sensing sensors allow for advanced musical control even after the event has been triggered.

In MIDI, the signal generated by the pseudo-strings 10 can be translated to what is referred to as "polyphonic aftertouch," or musical events that can subsequently modify an initial note command. MIDI is the standard for digital music interfacing, though other protocols exist (for instance, OSC). Other musical interface protocols, such as OSC (discussed below) allow for even greater modulation capabilities before and after note triggering. The instrument is compatible with these other standards through firmware modifications. Either with MIDI or other protocols, the Fingerboard 20 or Strum Section 30 can be configured to trigger musical events that are not merely note events. This could include effects processing (such as "wah" effect) that is modulated by the amount of pressure applied to the Fingerboard 20, as well as triggering multiple synthesizers at once. Alternatively, the pseudo-strings 10 can be used in ways that do not trigger notes at all. For example, the pseudo-strings 10 can be configured to act as mixing faders, as one might see on standard multi-track recording consoles. In this way, the instrument can act as a mixer for recording finished songs while controlling a standard DAW application. These advanced functions can be modulations of pitch or entirely different effects, including the modulation of a separate instrument or parameter. For example, the pseudo-string 10 has the ability to play one set of notes at each Fret 40 while simultaneously modulating additional properties of these notes. This ability is made possible because of the measurement of force or pressure. This "third-dimension" of musical expression is key for creating a performance-quality instrument, and distinguishes the instrument from the majority of MIDI controllers and toy instruments. The use of force-sensitivity in the pseudo-string 10 greatly improves on existing hardware controllers. For example, it allows for string harmonies to be triggered if a user touches lightly on a pseudo-string 10, which is impossible without force-sensitive fingerboards. This is a common technique for stringed instruments such as electric guitars, but is not possible with MIDI instruments lacking force sensitivity.

The number of sensors 100 per pseudo-string 10 or Fret region 50 can vary according to the embodiment. The instrument can also interpolate signals between sensor 100 locations to trigger additional notes. This allows, for example, non-western musical scales to be played along the same length of a pseudo-string 10, which would be impossible with traditional Fret-triggered strings. It also allows for pitch bend, a common musical technique, to be used between Frets 10. This is distinct from the common practice of pitch bend on MIDI instruments when sliding from one note to another note (technically known as "glide"), but is similar in effect to the pitch-wheel found on most MIDI keyboards. In the case of the instrument, this functionality is enabled through software algorithms to interpolate between the sensors 100 themselves rather than as an external modulating trigger ("whammy-bar") or rotary pitch-wheel. The design of the sensors 100 along the Fingerboard 20 aids this process, as the sensors 100 need not be limited to discrete Frets 40. Interpolation between sensors 100 is also what allows for the fundamental non-Fretted playability of this instrument, which when used in combination with force sensitivity is unique to the instrument and allows for the instrument's versatility.

Alternatively, the Fingerboard 20 need not be configured as pseudo-strings 10 and can instead consist of a matrix of triggers on a grid, the grid having an X and a Y axis rather than linear pseudo-strings 10. Each sensor 100 can then be used to trigger notes or other effects in two dimensions at any location on the grid on the X and Y axes rather than just along a line. The notes may be configured on-the-fly through software. This is allows for musical expression unlike keyboards or traditional stringed instruments, and reflects many of the modulations that electronic musicians now use with touchscreen digital tools. The instrument may provide tactile and ergonomic improvements for handling by a user.

For instance, the Fingerboard 20 can be used as a fader to trigger multi-track mixers in a standard DAW.

As shown in FIG. 1, in addition to the Fingerboard 20, the instrument may also have a separate Strum Section 30. While the Fingerboard 20 can trigger musical events directly, it is also possible to queue the signals from the Fingerboard 20 and trigger them only when the Strum Section 30 has been touched. In this way, the instrument emulates the majority of stringed instruments that do not have keys, which are played with two hands: one hand to determine notes, and one hand to activate those notes. Techniques for achieving this functionality vary according to the instrument that the instrument is emulating. For instance, in a guitar-like mode the notes would only be triggered when the Strum Section 30 is strummed and then sustained after initial contact (with a long "decay"). In the case of a violin, the Strum Section 30 would be activated by a virtual bow: as a finger or Synthetic Bow slides across it, the Strum Section 30 emulates the physical action of a bow across traditional strings. The Strum Section 30 can also be used to fade in notes from the Fingerboard 20, as with a volume pedal often used with a lap steel guitar.

The instrument is capable of being connected to software on mobile devices and computers that can extend its functionality. Input interfaces on those devices can be fed into the instrument's MIDI processing, which can enable hybrid musical techniques. For example, the instrument can receive data from the accelerometer on a mobile device (phone, watch, etc.) and translate a user's movement into violin bow-like gestures. This means that a user can move a mobile device around in the air and it will trigger notes to be played, with note attack and volume based on the intensity of the mobile device's movement. The notes to be triggered are determined by finger positions on the fingerboard of the instrument.

More details about possible and unique instrument modes are discussed below, each of which are made possible because of the hardware and software flexibility in the Strum Section's 30 design.

The Strum Section 30 can alternatively be used to trigger musical events which are distinct from those being triggered by the Fingerboard 20. These might include percussive elements such as drum machines, bass lines, chordal or arpeggiated musical phrases, or effects processing such as faders and parameter triggers. These functions can also be used simultaneously and identically with the Fingerboard 20 section.

Because each sensor 100 can be mapped in MIDI according to the user's preference, the Strum Section 30 can be used either as a note triggering or effect triggering surface. It can be made from the same materials and have the same potential for force sensitivity as the Fingerboard 20. Unlike traditional stringed instruments, where a 'strumming' area is used exclusively for triggering the notes specified on the Fingerboard 20, the instrument can be treated as two or more distinct instruments housed in the same body. This is similar to the functionality of MIDI keyboards that also contain a drum pad above the key. However, what is unique to the instrument is the translation of this flexibility to a string-like instrument, as well as the ability to use the Strum Section 30 to trigger notes directed by the Fingerboard 20 or entirely independent from the Fingerboard 20.

Figure 4:
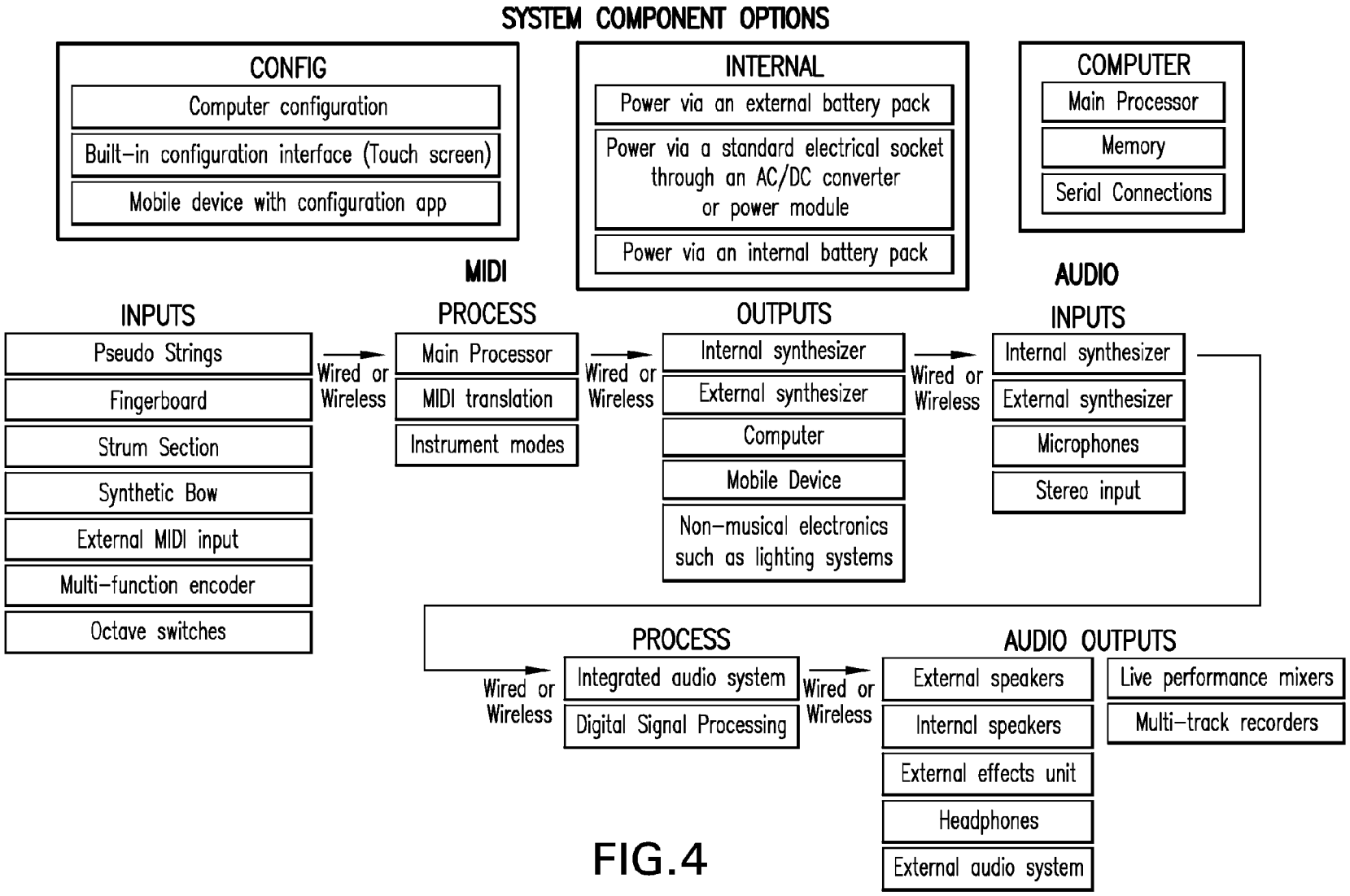
FIG. 4 is a flow chart showing possible configurations of an instrument with different Internal Peripherals and External Peripherals.
Figure 5:
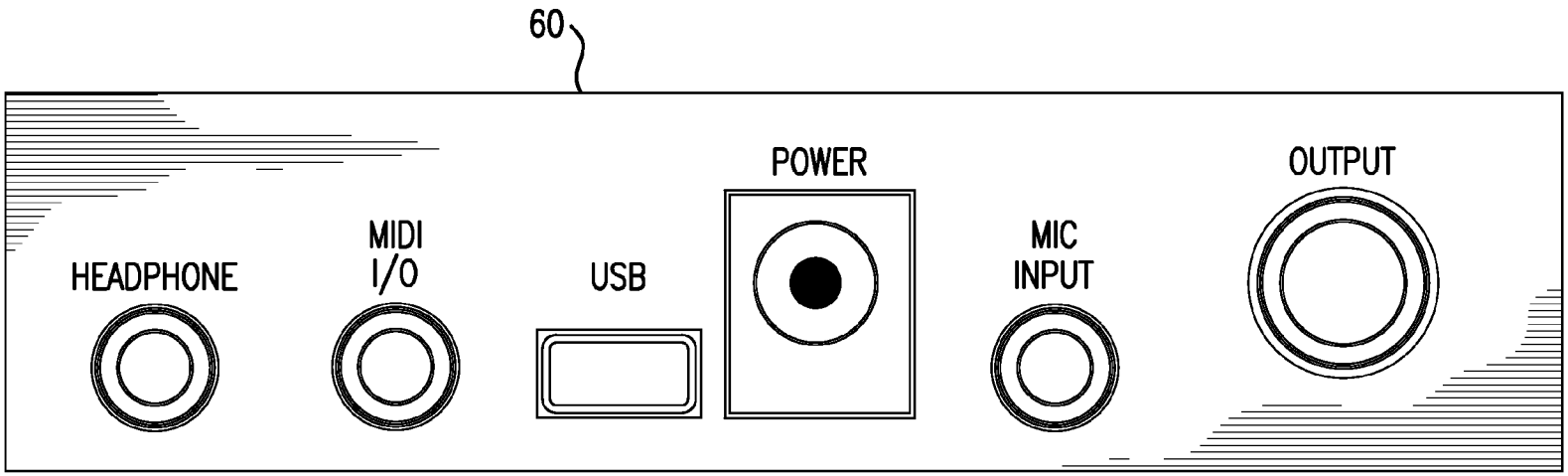
FIG. 5 is a top view of an input/output panel for wired connections.

The psuedo-strings 10 of the instrument are not the only way to trigger notes from the instrument. As listed in FIG. 4, many different External Peripherals may be used with the instrument. External Peripherals can also be connected to the instrument to trigger either the Strum Section 30 or the Fingerboard 20 in a variety of ways. One option is Synthetic Bow. Another option includes sensors on the External Peripheral or the instrument that detect visual or spatial positioning of a user's movements. Another option includes using an External Peripheral such as a foot pedal instead of a Strum Section 30. Each of these could be used instead of or in addition to the triggering capabilities embedded within the instrument. These External Peripherals may be connected through a wired (MIDI, USB, or other serial connection) or a wireless connection (Bluetooth, WiFi, or other wireless data protocol). As shown in FIGS. 1 and 5, in one embodiment, the instrument comprises an input/output panel for wired connections. Depending on the instrument that the user wishes to emulate or create with the instrument, these External Peripherals may be an integral part of achieving realistic playability. This is especially apparent for the bow embodiment, but could also be essential for a virtual Theremin or instruments that use sliders on standard strings, such as a lap steel or pedal steel guitar.

There are several traditional instruments that may be emulated by one or more embodiments of the instrument, such as a guitar, bass, violin, banjo, and steel guitar.

In one embodiment, the instrument has a control or configuration panel 50 so that a user may select from standard instrument setups with which he or she may already be familiar or wish to learn familiarity through practice. These include examples already mentioned, including many more, given the flexibility of design of the Fingerboard 20, Strum Section 30, and external triggering configurations. Outlined here are a few embodiments to illustrate the varieties of traditional analog instruments that the instrument can emulate.

In one embodiment, the instrument has a built-in accelerometer and gyroscope which measure rotation and acceleration, which the instrument can use to determine the position and movements of the instrument. As a user moves the device into different ergonomic playing positions (e.g., upright, across the chest, level on the lap or table), the gyroscope and accelerometer report the movement to the instrument and the instrument is able to detect which playing position it is in. The instrument can, in one embodiment, change modes automatically based on how it is being held. One specific example is that the instrument can determine whether it is being held and played in a left-handed or right-handed orientation.

In one embodiment, the motion detection can also be translated into performance effects, such as wah-wah or tremolo. For instance, the instrument can be set to recognize shaking as a trigger to change the pitch with a vibrato effect. This allows a user to play vibrato by shaking the instrument.

Figure 6:
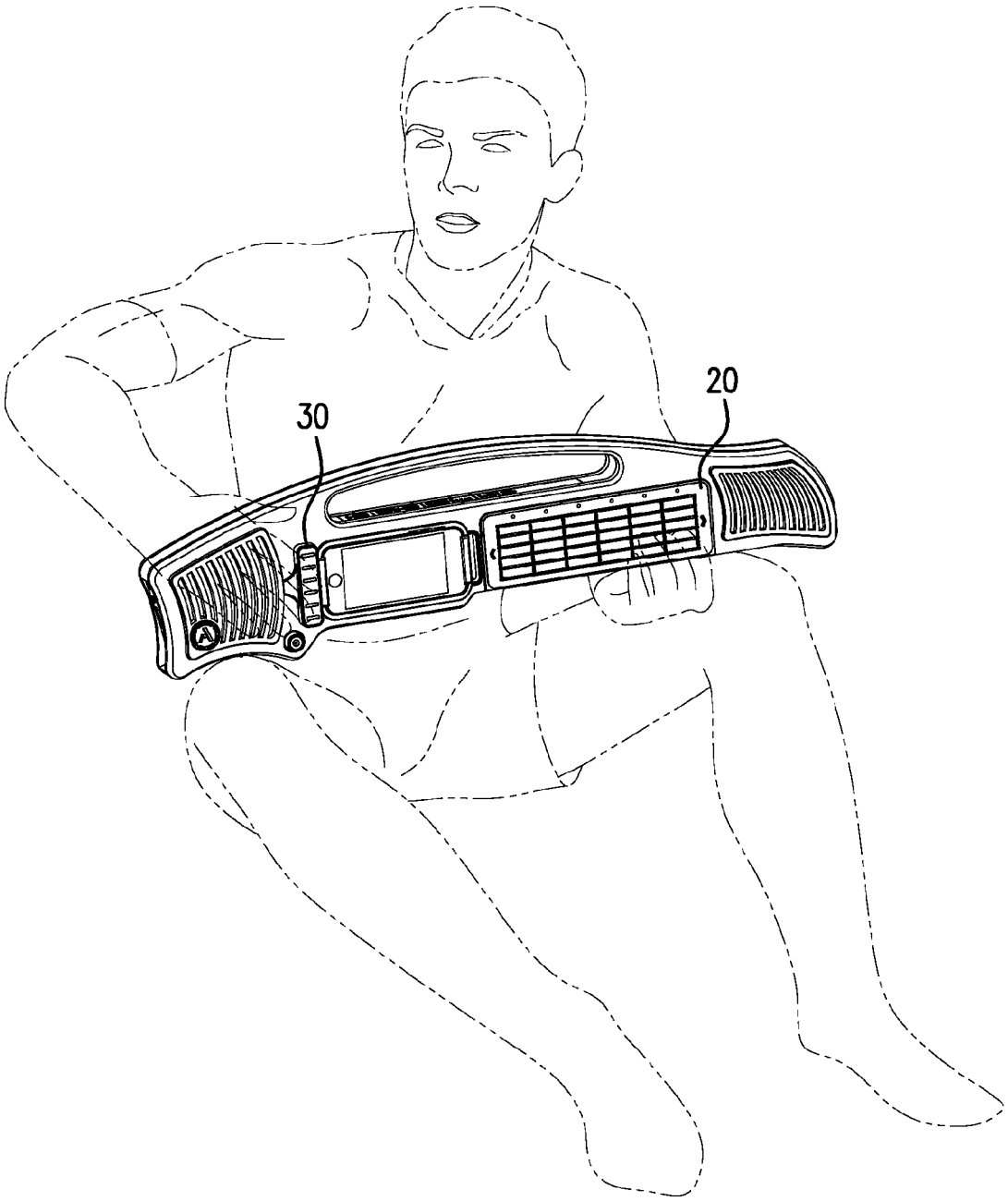
FIG. 6 is a depiction of a user playing an instrument using a guitar playing technique.

As shown in FIG. 6, the instrument can be played as a traditional guitar or a bass guitar. In "guitar" mode, notes will be triggered via the Strum Section 30. The notes will be determined based on finger positions along the Fingerboard 20. The user can prepare a chord on the Fingerboard 20, for instance, and then strum it on the Strum Section 30 as on a standard guitar body. The volume and modulation of the sound may be controlled via pseudo-strings 10 on the Fingerboard 20 and the Strum Section 30. Additionally, for advanced playability, hammer-ons and pull-offs are possible. The tuning can be standard (e.g., a note progression as follows: E-A-D-G-B-E), though this can be configured by the user to be another note progression, scale or sequence. This mode most similarly resembles an acoustic guitar. "Bass guitar" mode has a few significant modifications from guitar mode. Instead of just triggering notes when the Strum Section 30 is being strummed, notes will also be triggered by touching the Fingerboard 20 itself. This functionality mimics the behavior of an electric bass or high-gain electric guitar, where the strings are very sensitive to touch but can also be strummed. The sustain on the notes will also be longer than on the guitar setting. The tuning is that of a standard bass.

Figure 7:
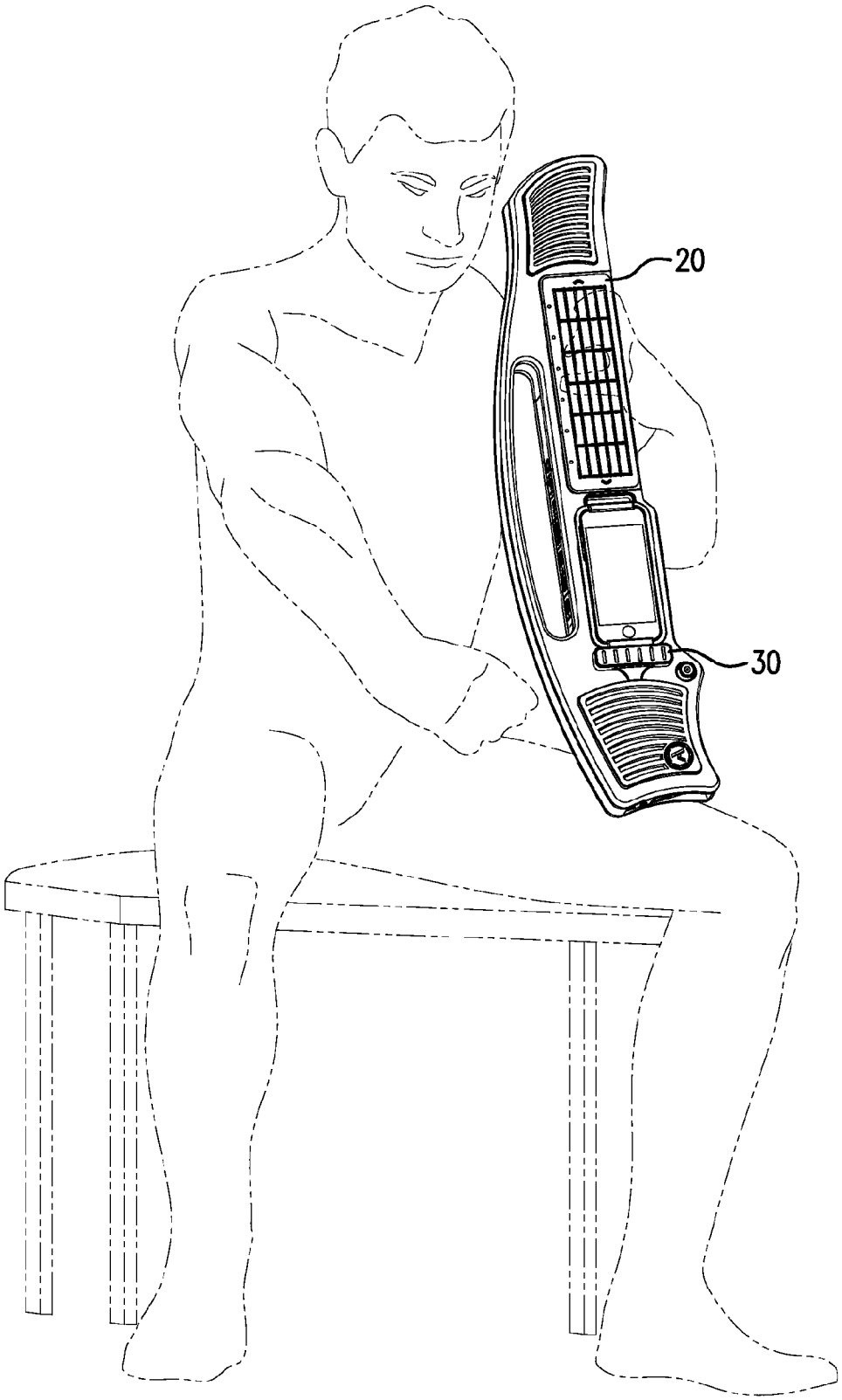
FIG. 7 is a depiction of a user playing an instrument using a bass playing technique.
Figure 8:
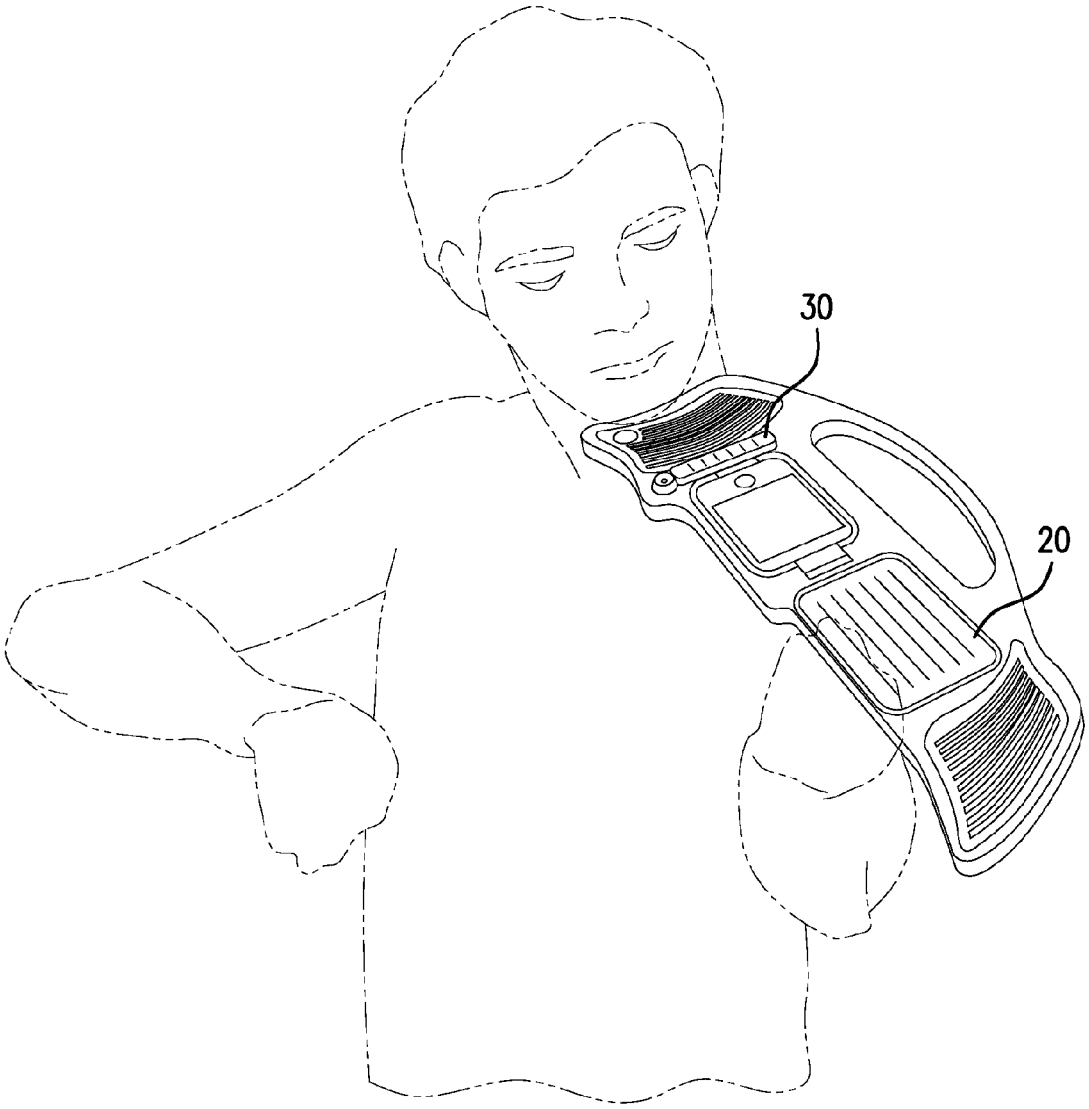
FIG. 8 is a depiction of a user playing an instrument using a violin playing technique.

As shown in FIGS. 7 and 8, the instrument can be played as a traditional cello or a traditional violin. These modes demonstrate the difficulties in simulating stringed instruments. The introduction of the bowed string sound in addition to plucked tones, with variations of length and intensity, is accomplished through software. When the user slowly glides his or her finger or a Synthetic Bow across the Strum Section 30, the length and intensity of the sound produced corresponds to the speed of the movement on the psuedo-strings 10. In one embodiment, plucked tones will occur when a single psuedo-string 10 is tapped, and indefinite bowing will occur when the pseudo-string 10 is held (the intensity determined by how many are held or how hard they are pressed). It will be tuned for the ranges of standard violin family of instruments such as violin, viola, and cello.

Figure 9:
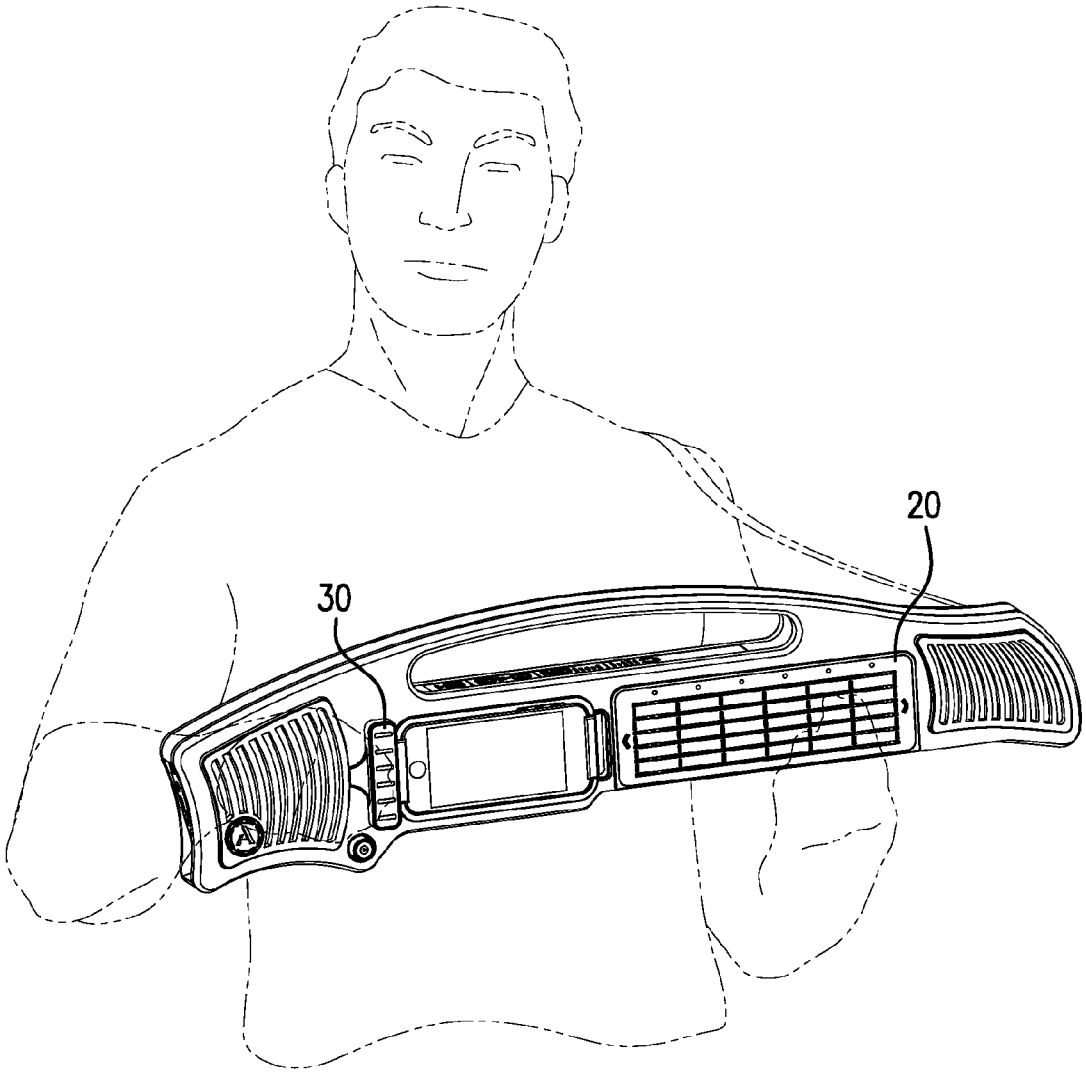
FIG. 9 is a depiction of a user playing an instrument using a banjo playing technique.

As shown in FIG. 9, the instrument can be played as a traditional ukulele or mandolin.

Figure 10:
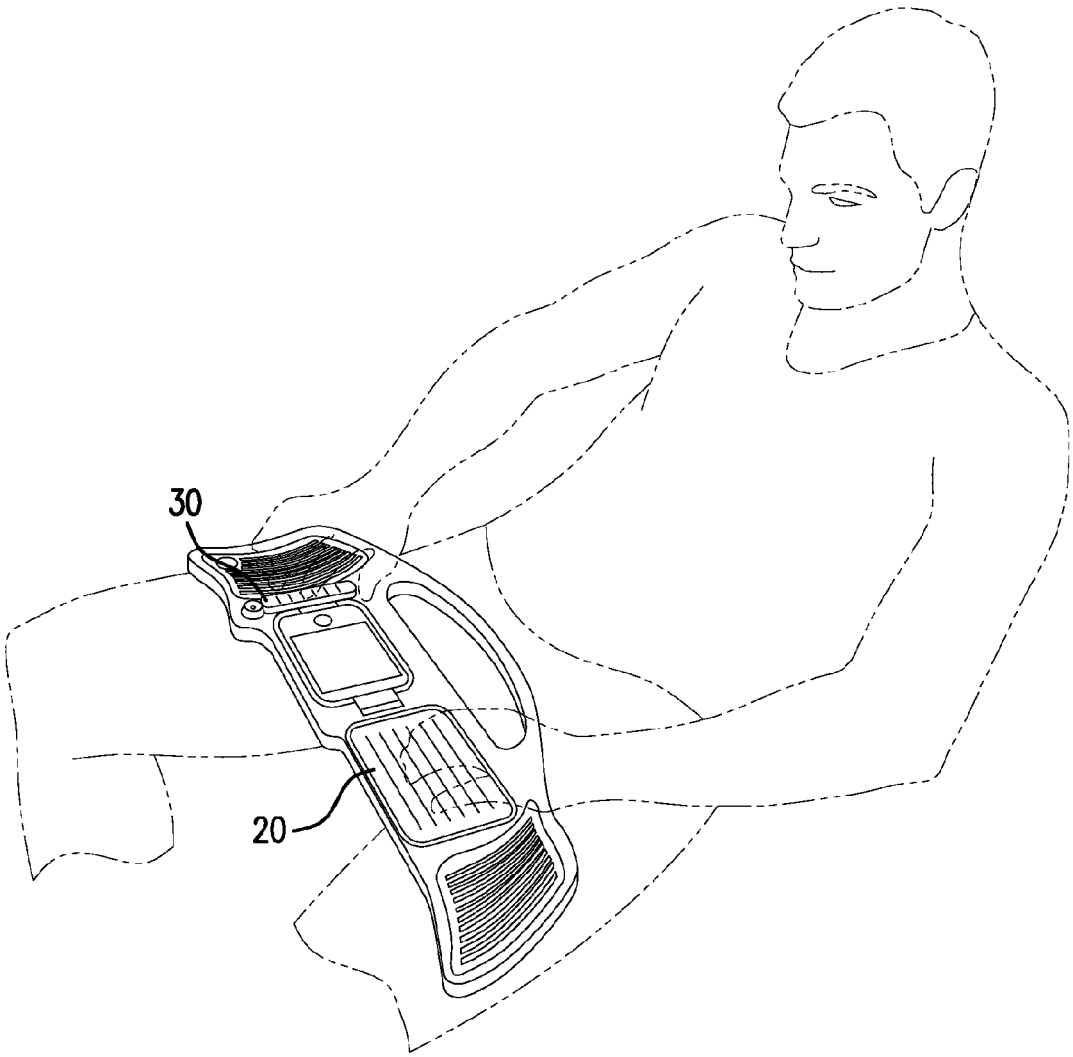
FIG. 10 is a depiction of a user playing an instrument using a lap steel guitar playing technique.

As shown in FIG. 10, the instrument can be played as a traditional lap steel guitar. In "lap steel guitar" mode, the Fingerboard 20 will be tuned to various chords depending on the user's preference. The Strum Section 30 will have two functions. When touched, it will begin the note determined by the Fingerboard 20. As it is held, it will increase the volume of that note to emulate a volume pedal as commonly used in conjunction with steel guitars. In one embodiment, the instrument is configured so that each pseudo-string 10 will have its own volume adjustment. This functionality is not present in traditional instruments, but is a natural extension of standard playability and will be easy to learn given the traditional technique of plucking the notes and fading the volume pedal with the foot.

Although not depicted in the figures, the instrument can be played as a traditional banjo. The "banjo" mode features an arpeggiation feature, which approximates the various picking styles (i.e., repeated sequences of notes) normally employed by banjo players. This automatic strumming feature gives the user an easily accessible means by which emulate finger picking styles that otherwise take a lot of practice to master, thus lowering the skill required to play arpeggio convincingly. The arpeggiator will be enabled when the user touches the Strum Section 30, and the Fingerboard 20 will determine which notes will be cycled through in sequence.

There are many parameters that can be affected by such configurations, including pressure sensitivity, tunings, triggering techniques, MIDI translation, and so forth. Therefore, the possibilities for customized instrument modes are highly variable, which is a crucial element in the creation of this instrument. In short, it is not merely the tuning but the actual playable technique that is modified in the instrument settings.

Custom modes can also include functions which would be impossible on real strings, but are made possible because of the synthetic nature of the psuedo-strings 10. In one embodiment, a user can trigger multiple notes on the same psuedo-string 10 by pressing down at multiple locations at once. This is impossible on a normal stringed instrument, as only the highest position on a traditional fingerboard is audible. As a modification of "guitar" mode, for instance, this allows for greater than six-note polyphony with six pseudo-strings 10, which is impossible on a traditional guitar that is limited to six strings.

Figure 11:
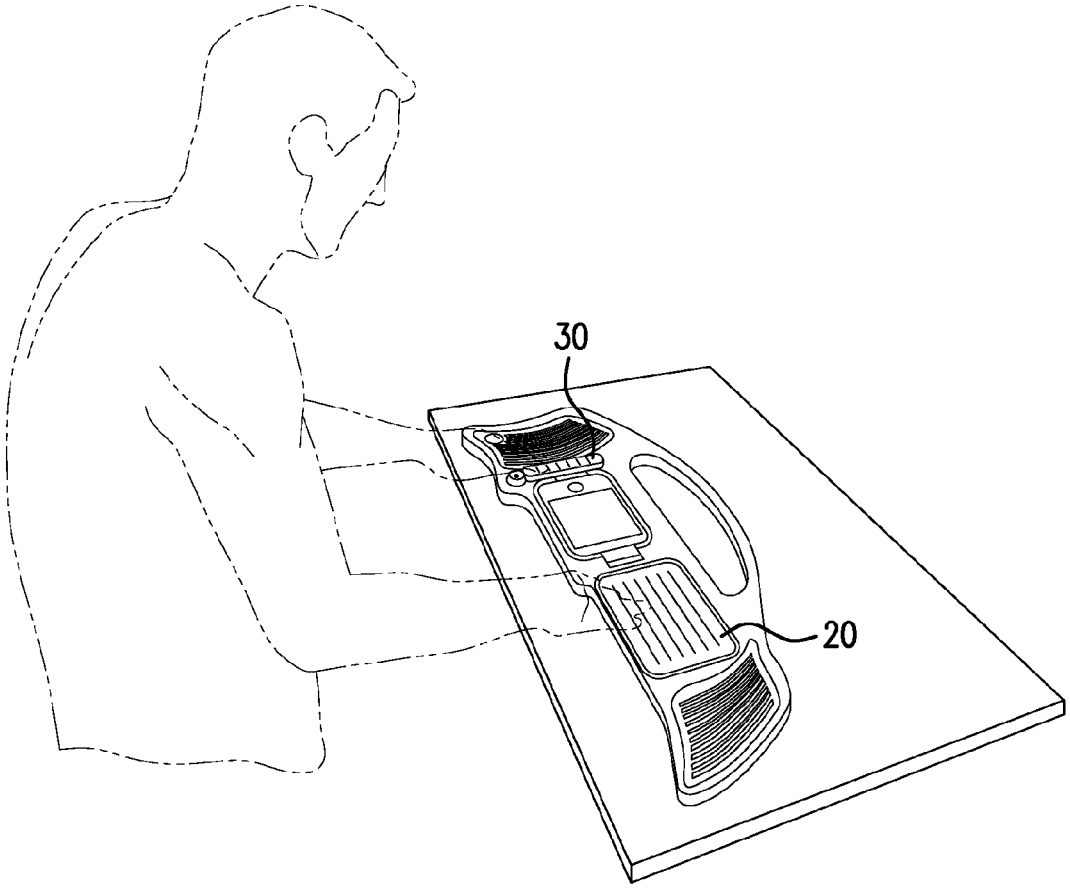
FIG. 11 is a depiction of a user playing an instrument using a non-traditional playing technique.

The instrument is not limited to the pre-programmed configurations. Users may modify the instrument's settings to create custom instrument forms and playing techniques, as the technique illustrated in FIG. 11. Users can modify settings using an External Peripheral connected to the instrument.

These configurations can be stored internally to the instrument and recalled at a later time. They can also be stored externally and shared among users, creating the opportunity for communities or economies to form around instrument configurations similar to those that have formed around synthesizer patch settings.

As shown in FIGS. 6 to 10, the body design and shape of the instrument accommodates multiple playing techniques and is a component of its multi-instrument capability. This body design can include ergonomic elements of traditional stringed instruments such as the shapes and sizes of guitars, basses, violins, banjos, lap steel guitars, dulcimers and others. Drawing on this lineage of stringed instruments allows users to play the instrument in familiar ways, while also enabling seamless transition from one playing position to another without physically switching instruments.

The instrument can be played in multiple positions, including as a stringed instrument with a neck or a piano-like instrument with keys. In one embodiment, the shape of the instrument can enable these multiple functions and accommodate the standard musical gestures of those different types of instruments (i.e., vertically strumming and fretting vs. tapping on a horizontal surface).

In one embodiment, the neck profile for the back of the fingerboard allows for multiple playing styles and corresponds to common sizes to enable a user's muscle memories. In one embodiment, the neck profile on the back of the fingerboard also allows it to lay flat in a user's lap on its back. Guitars and violins have very different neck widths and the instrument has the ergonomics of both.

In one embodiment, the neck has two curves instead of the traditional single curve found on a standard guitar or a standard violin neck. The smaller neck outline is inset from the larger neck outline, and the smaller neck outline provides a thumb-rest on the underside to stabilize a user's hand for violin-type fingering. By contrast, the larger neck outline is the size of a standard or traditional guitar. In this way, the instrument feels like a standard violin and also like a standard guitar depending on which neck outline the user holds. Unlike a standard or traditional stringed instrument, the back of the neck of the instrument is flat on the underside so that it lays flat when placed on a player's lap. A standard guitar neck would rock back and forth because it is rounded.

Additional playing positions may include the following: horizontal on the thigh like a bass guitar; vertical on the thigh like a cello, upright like a harp; lifted horizontally at the torso like a mandolin or ukulele; rested horizontally on the shoulder and extending outward like a flute; laid flat on the lap like a dobro; laid flat on another surface like a pedal steel guitar or keyboard; or suspended via a shoulder strap from the torso.

The body of the instrument may also be shaped as a novel design that is based entirely on intended ergonomics, without any explicit references to traditional stringed instruments. In this embodiment, the observable shape of the instrument may be unfamiliar until it is played by a user, who will then notice and utilize the familiar traditional positions in which it can be played.

Figure 12:
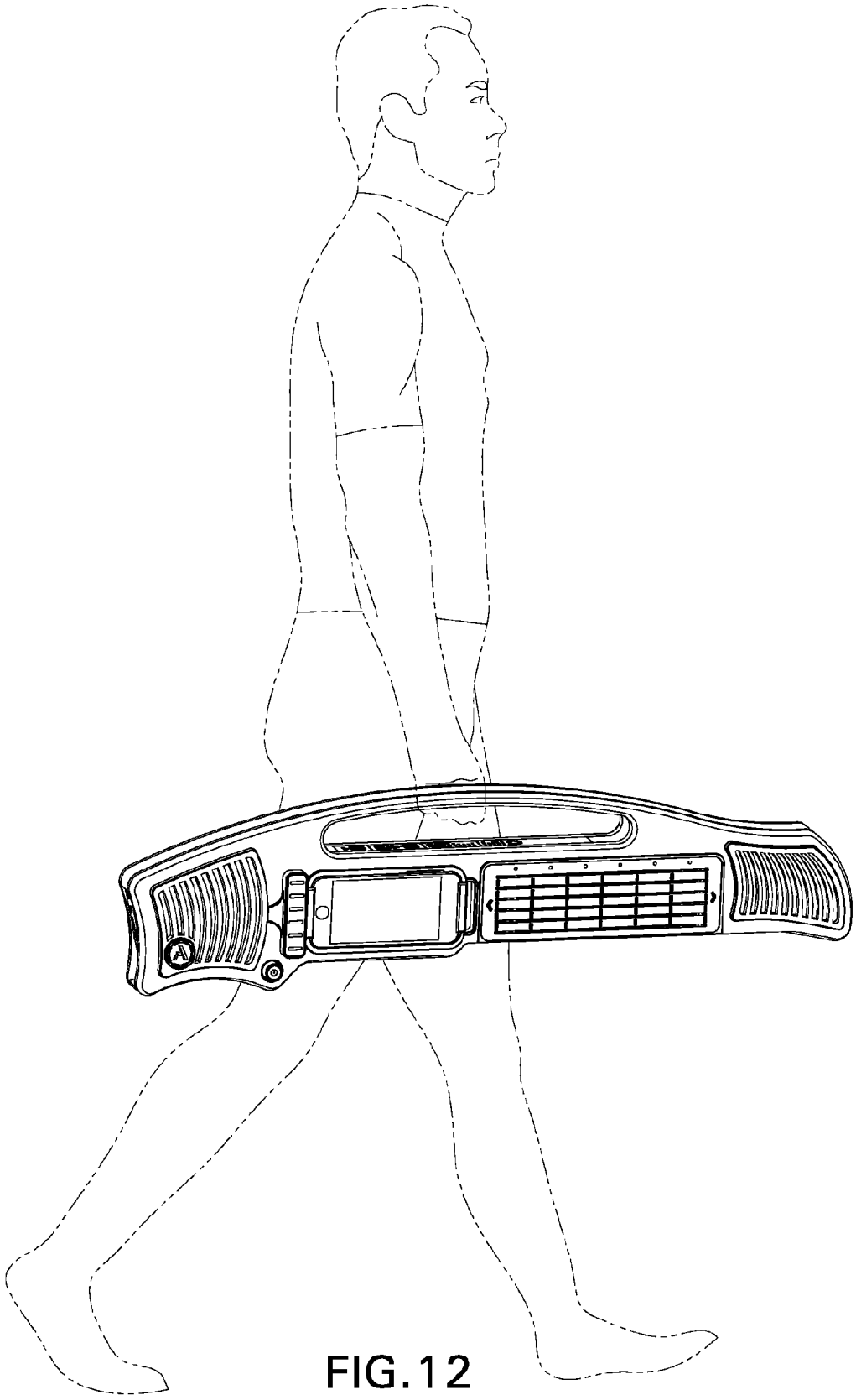
FIG. 12 is a depiction of a user holding an instrument when it is not being played.

Whether traditional or non-traditional in shape, the instrument allows the user to easily switch between playing positions. As the invention also contains tunable electronic sensors and configurable instrument modes, a user is able to fully customize the playability of the instrument to fit his or her particular style and preference. The unique designs of each embodiment of the instrument carry the same function, which is to provide a versatile body form for users of various sizes and ages to comfortably play familiar or unfamiliar instruments. In other words, to create a universal string-like instrument that is highly configurable for individual needs, skills, and preferences. There are many educational opportunities afforded by enabling more accessibility in instrument forms, particularly when paired with software applications that encourage the development of musical skills. Traditionally, students are limited to on-screen or keyboard-based musical learning tools. Music theory is most often taught with keyboard skills, since the learning curve for stringed instruments is so tedious. The instrument enables more accessibility to stringed instrument music teaching because it foregoes the difficulties of learning to play strings (buzzing, tuning, etc.) and provides immediate access to easier string techniques. As a tool for music educators, the instrument saves money in addition to time. Because a teacher can now buy one instrument that can do the virtual work of a wide variety of other instruments, a classroom need not stock a great number of instrument types. Instead, students can learn a variety of techniques on the instrument and then translate these techniques directly to traditional stringed instruments. An additional feature, as shown in FIG. 12, is that the instrument may comprise a built-in handle to allow for easier handling when not in use.

Figure 13:
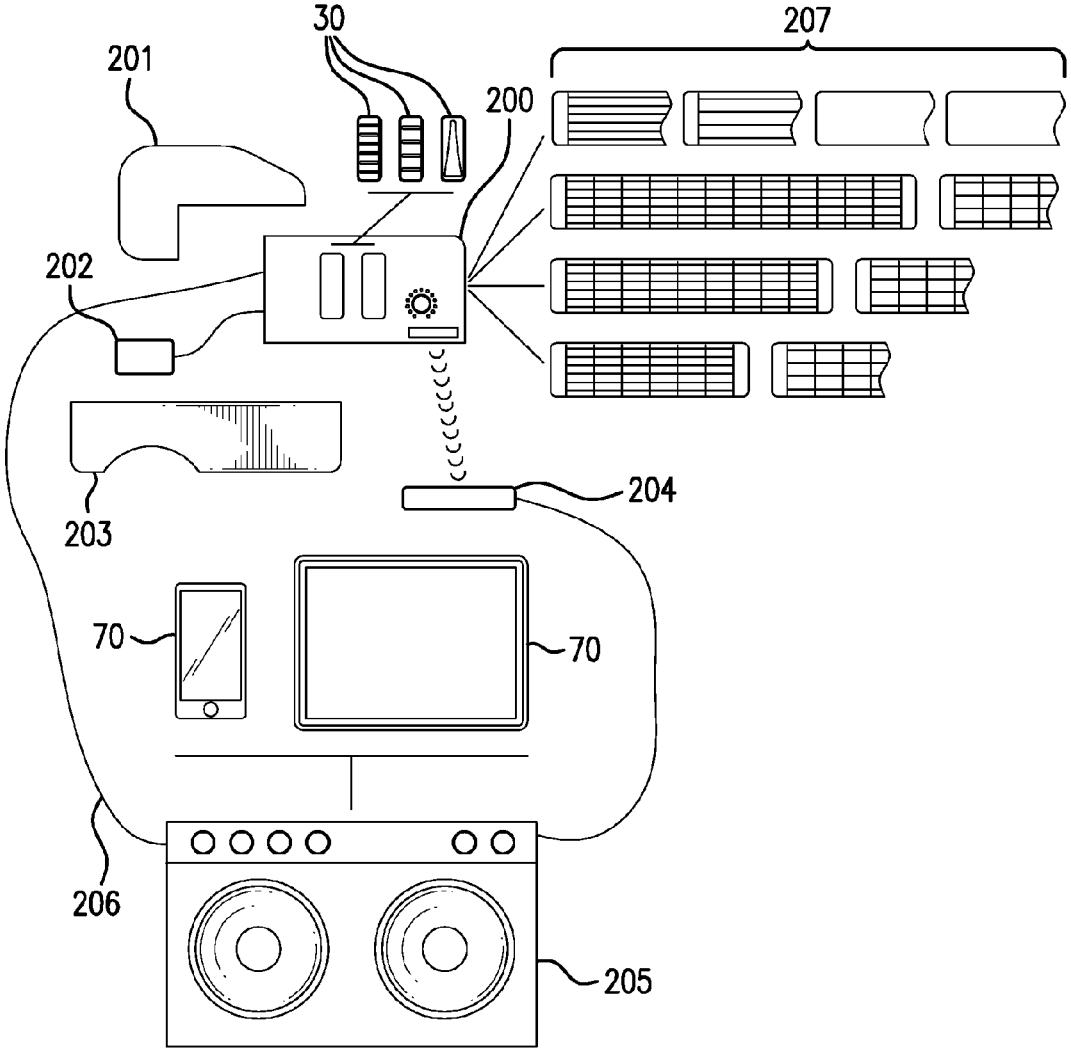
FIG. 13 shows various peripherals that can communicate with an instrument.
Figure 14:
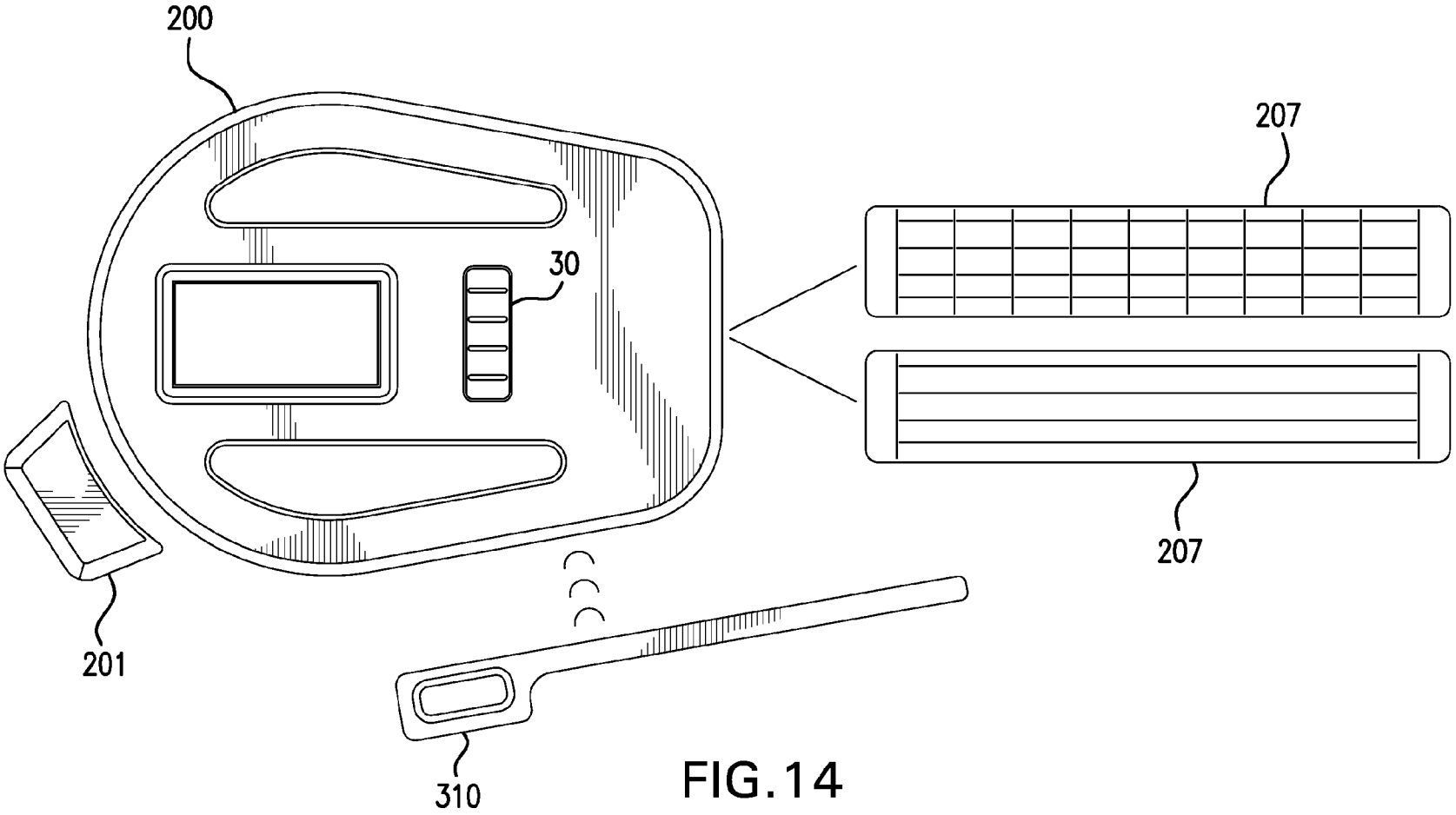
FIG. 14 shows a front view of an instrument with a Fingerboard separated from the Strum Section.

As shown in FIGS. 13 and 14, in another embodiment, the body form of the instrument can have various detachable parts, allowing it to be configured in different ergonomic positions and sizes. These additional modular parts could be a chin rest 201 that would allow the instrument to be played more comfortably in a violin-like, shoulder-mounted position. Alternatively, a thigh rest 203 attachment might better accommodate the instrument played upright like a cello or bass. A shoulder strap attachment might enable other playing positions, as is the case with traditional stringed or other instruments (accordions, for instance). A pedal 202 would allow additional control over the instrument. This embodiment would consist of a core processor 200 with alternative parts to attach to it, including multiple neck configurations 207, body form extensions, and connection panels.

In several embodiments, the Fingerboard of the instrument will be situated above a neck-like section, which can be embodied in multiple forms. The sensors 100 of the Fingerboard 20 will be enclosed within this neck area. A section of the body may be cut away in order to allow the user's hands to more fully wrap around the instrument. It may also be extended from the body as with many common stringed instruments. As mentioned above, it may either be fixed to the body or removable and interchangeable.

The body of the instrument can be made from a wide variety of materials. Traditional stringed instruments are often made of wood, which can be hand-cut, laser-cut, or routed. Plastics or recycled pulp materials can also be used, either through a subtractive cutting process or an injection mold. The body can also be constructed using 3D printing techniques, which would enable body shapes and interconnected pieces unavailable using other manufacturing techniques.

As shown in FIGS. 13 and 14, the instrument has capabilities that allow it to connect to External Peripherals in various ways, both wired and wirelessly. It can connect to Peripherals that respond to MIDI commands, OSC commands, and other musical data languages. It also has ports for connecting to headphones, microphones, external speakers 205, and outputs for sending audio signals to be recorded externally. The cabled connections 206 can be achieved with a standard MIDI cable, a standard audio cable, or a USB cable. Wireless connections can be achieved using wireless receivers 204 through WiFi, Bluetooth, or other protocols.

These methods of connection listed above allow the instrument to connect to External Peripherals that can be used for configuring instrument mode settings and updating internal software.

Figure 15:
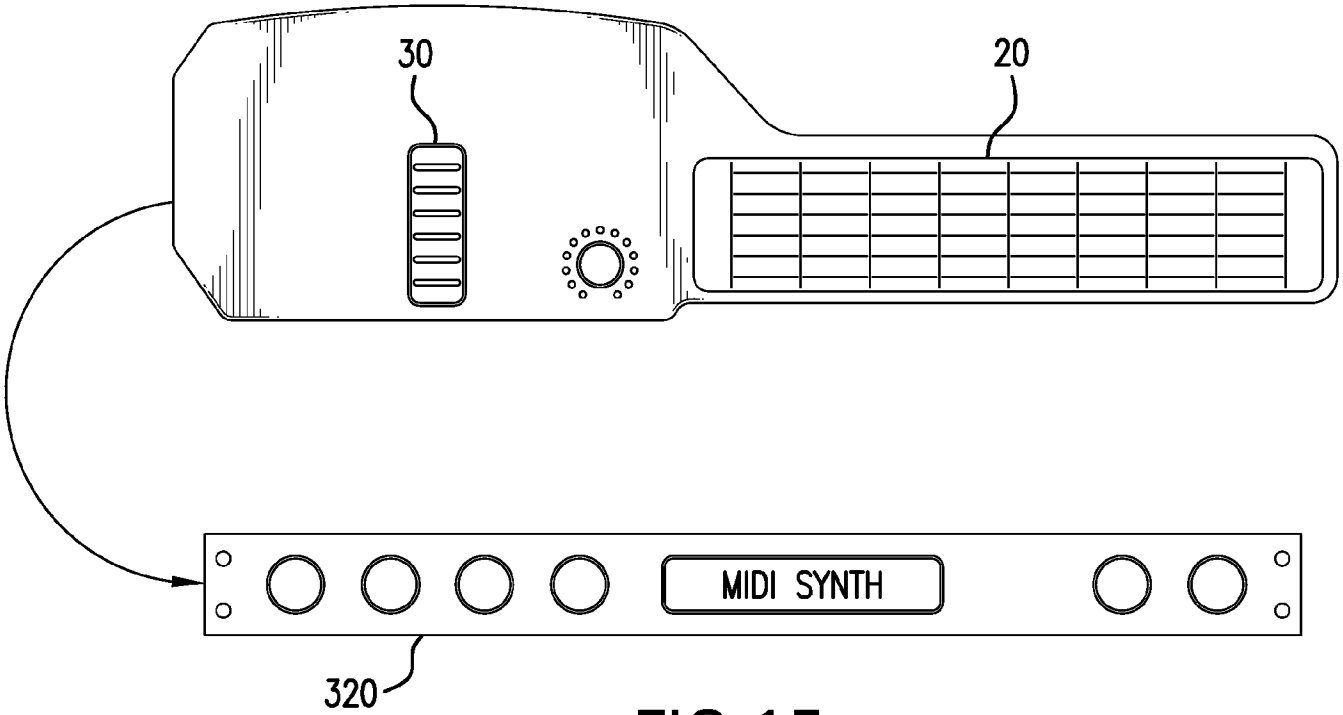
FIG. 15 is a front view of an instrument connected to an external synthesizer peripheral.

A synthesizer translates music data signals into sound, either digitally or with analog electronics. The inclusion of this function enables the instrument to be heard and can be embodied in multiple ways. A synthesizing Peripheral can be built into the instrument as an Internal Peripheral, feeding directly into a sound system internal or external to the instrument. As shown in FIG. 15, Alternately, an External Peripheral may be connected to the instrument by way of MIDI cables or other data connections. A separate, remote synthesizing Peripheral may even be integrated or "docked" into the body by way of a recess in the body and a holding mechanism for the instrument. This Internal Peripheral could be removable and connected to the instrument digitally through various data connection options and used as an External Peripheral.

Switches on the instrument enable communication between the instrument and a Peripheral, either internally or externally connected. These switches can change the synthesizer sound patch used to determine how music data is translated into audio signals. This communication may occur using the General MIDI (GM) protocol, which is a common means in the industry to change sound patches on MIDI equipment.

A sound system may be integrated into the instrument to enable full acoustic performances and playback within the same instrument. This sound system would comprise an audio input from a synthesizer or other source, an amplifier for speakers and/or headphones, and one or more speakers for sound transduction. One of the primary benefits of including speakers in one embodiment of the instrument is the ability to listen directly to sound being produced by the instrument, rather than only through connections to External Peripherals. Additionally, the inclusion of a sound system along with multi-track capabilities (discussed below) allows for playback of musical parts in addition to performance, which enables users to layer performed parts over one another and play along with their own tracks.

A multi-function encoder Peripheral may be incorporated onto the instrument body to allow for a variety of functions within the same user interface. This encoder Peripheral can be used to modify MIDI commands, change volume levels for inputs and outputs, and modify the level of various effects. The encoder Peripheral can change functions, or functions can be changed with an alternative control. Examples of encoder Peripherals are rotary encoders and resistive touch strip encoders.

The instrument has user feedback indicators that inform the user of the various settings at any given time. These indicators are illuminated signals that tell the user information such as: which relative octave each pseudo-string is currently set to, the functions the encoder Peripheral is controlling, what instrument function is currently employed, and what synthesizer patch is being triggered.

The instrument can achieve multi-track recording directly within the instrument itself or an Internal Peripheral without connecting to External Peripherals, thus having the function of a "studio in an instrument." It can do this in several ways. In one embodiment it can achieve multi-track recording via built-in digital recording capabilities. Internally, it can record MIDI data as multiple tracks, and it can synthesize MIDI signals into audio and record the resulting audio into multiple tracks.

One embodiment of the instrument can also achieve multi-track recording by communicating with an External Peripheral such as a touch-screen computer or standalone multi-track recorder. Such an External Peripheral may dock into the instrument and share data via a physical connection. In one embodiment, a recording External Peripheral may dock into the instrument and/or pair with the instrument via a wireless connection (Bluetooth or WiFi). The recording External Peripheral may also attach but not fully dock to the instrument via a physical or wireless connection. Alternatively, the recording External Peripheral may connect over a wired or wireless connection but not physically dock into the instrument. The instrument routes MIDI signals or synthesized audio into the instrument via one of the methods listed above, which would in turn be configured to capture multiple recorded tracks.

The instrument may also communicate with a Peripheral for the purpose of synthesizing audio, recording musical data, creating audio effects, and other functions. A synthesizing Peripheral may connect to the instrument in several ways. The synthesizing Peripheral may dock into the body of the instrument and be connected via a wired or wireless connection. Or it may remain external to the instrument and connect via a wired or wireless connection. Once connected in one of these ways, the synthesizing Peripheral can function as a synthesizer, translating signals from the instrument into audio. It can also receive audio from the instrument and add additional effects to that audio, the result of which is either routed back to the instrument or to an external output. The synthesizing Peripheral can also receive MIDI signals from the instrument, or send MIDI signals to the instrument, for the purpose of creating effects or modulation of the final audio output.

The pairing of the instrument to a general purpose Peripheral 70, as shown in FIGS. 1 and 13, allows for significant usability enhancements, for example, when used in conjunction with the wide variety of music-making apps available on iOS and Android platforms. These apps can synthesize, effect, record, and broadcast music. While the integration of such a general purpose Peripheral 70 with or into the instrument extends the functionality of the core components of the instrument, a general purpose Peripheral 70 does not fundamentally change the multi-instrument functions of the invention.

The instrument can receive power in several ways. The instrument can be plugged into a standard electrical outlet through an AC/DC converter. The instrument can also be plugged into an external battery pack. The instrument can also draw power from an internal battery system. The instrument can include batteries that are replaceable by the user, or can be factory-integrated and hardwired into the instrument. Battery power enables the instrument to be fully portable and self-contained, enabling its use in multiple contexts including stage performances and travel.

As described herein, the instrument's versatile interface can be configured for a variety of expressive and productive functions. The Fingerboard 20 and Strum Section 30 can be used to trigger a DAW to mix pre-recorded music rather than perform new music. In one embodiment, an audio system including speakers can be used for sound playback. The instrument can be used as a music processor, either of digital music data using MIDI or of audio signals using the audio system. The instrument can be used as a gaming controller when connected to a Peripheral with appropriate software set to receive MIDI or other data from its inputs. These games may or may not be musical in nature. Alternatively, the instrument can be used to control any situation where advanced electronic controls would benefit from a versatile ergonomic interface, such as with lighting or display equipment.

Figure 16:
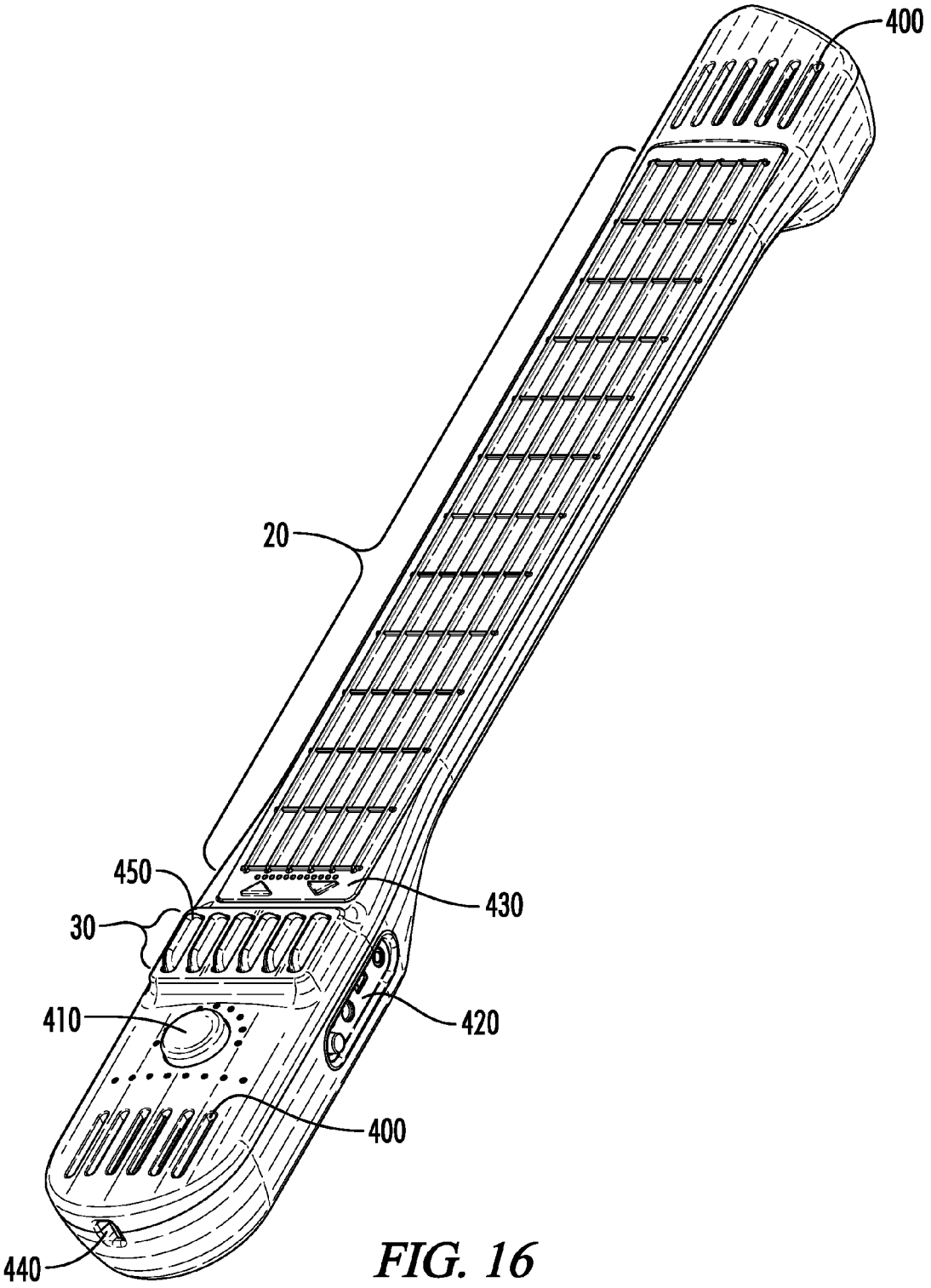
FIG. 16 is a perspective view showing an embodiment of the instrument.

As shown in FIG. 16, another embodiment of the instrument, the body of the instrument is based entirely on ergonomic functions that allow it to be played using techniques that are similar to multiple traditional instruments and fitting the muscle memory of a user but omits bulky acoustic features that are required for an acoustic instrument to generate sound reverberation. For example, as shown in FIG. 16, the body of the instrument can be the same or similar width along its length. As shown in FIG. 16, the instrument can have speakers embedded as peripherals with speaker grilles 400. A speaker and speaker cavity lie behind louvered slots in the speaker grilles 400, which allow for air movement while protecting the speaker from direct contact with foreign objects and hiding the speaker. The speaker grilles 400 can also present a clean appearance to the front of the instrument. In one embodiment, the strum section or bridge 30 is a secondary note input interface and note triggering feature capable of being assigned distinct notes (for example, bass notes—like foot pedals on an organ—or a six-part drum machine). The strum section (bridge) 30 is also used to trigger notes assigned from the fingerboard 20 using strumming or bowing techniques. In one embodiment, strumming and bowing techniques will not trigger a note until the bridge 30 is activated, either by strumming across or by holding down a trigger corresponding to a "string" on the fingerboard 20. The bridge 30 is pressure-sensitive, so volume and other effects can be adjusted dynamically for each note or string. The instrument can also have a fingerboard 20 and a bridge or strum section 30 that are in close proximity to one another or that are a single continuous piece. In one embodiment, the bridge or strum section 30 can have six distinct interface positions that can be pressed (downward) or strummed (sideways) to allow for different instrument techniques (keyboard-like or string-like). The instrument can have capo buttons and transposing indicators 430, for example LED indicators, which allow for the user to "capo" or transpose their instrument up or down twelve semitones during performance. The current transposition is indicated by lighting the LEDs either starting at the left (transpose up) or starting at the right (transpose down) 430. The instrument can have an input/output panel 420. The input/output panel 420 comprising: power button, power LED indicator (which displays battery level, charge status, and on status), DC power connector (for continuous power and charging), a USB port (for connecting to computers and mobile devices). The input/output panel 420 can comprise both MIDI (musical) data and sound data, and a dual headphone/microphone jack (four-contact TRRS). The instrument can also have a dial or other selector that can be used as a volume and preset selector knob 410. This dual-function knob 410 adjusts volume up/down with a turn, while also letting users cycle through built-in presets with press. Additional peripherals can be attached or connected to the device through a lower strap slot 440 and an upper strap slot 510. The strap slots on either end allow for a custom strap to be attached. The slots themselves are openings, roughly ¼" apart. The custom strap has thin velcro strips at either end, which are then threaded through these slots and attached back onto themselves. This effectively allows the user to hold the instrument in multiple positions, with easy removal when switching positions or no longer using the strip. The slots are also sleek with the body rather than protruding (as is the case with traditional stringed-instrument strap pins).

Figure 17:
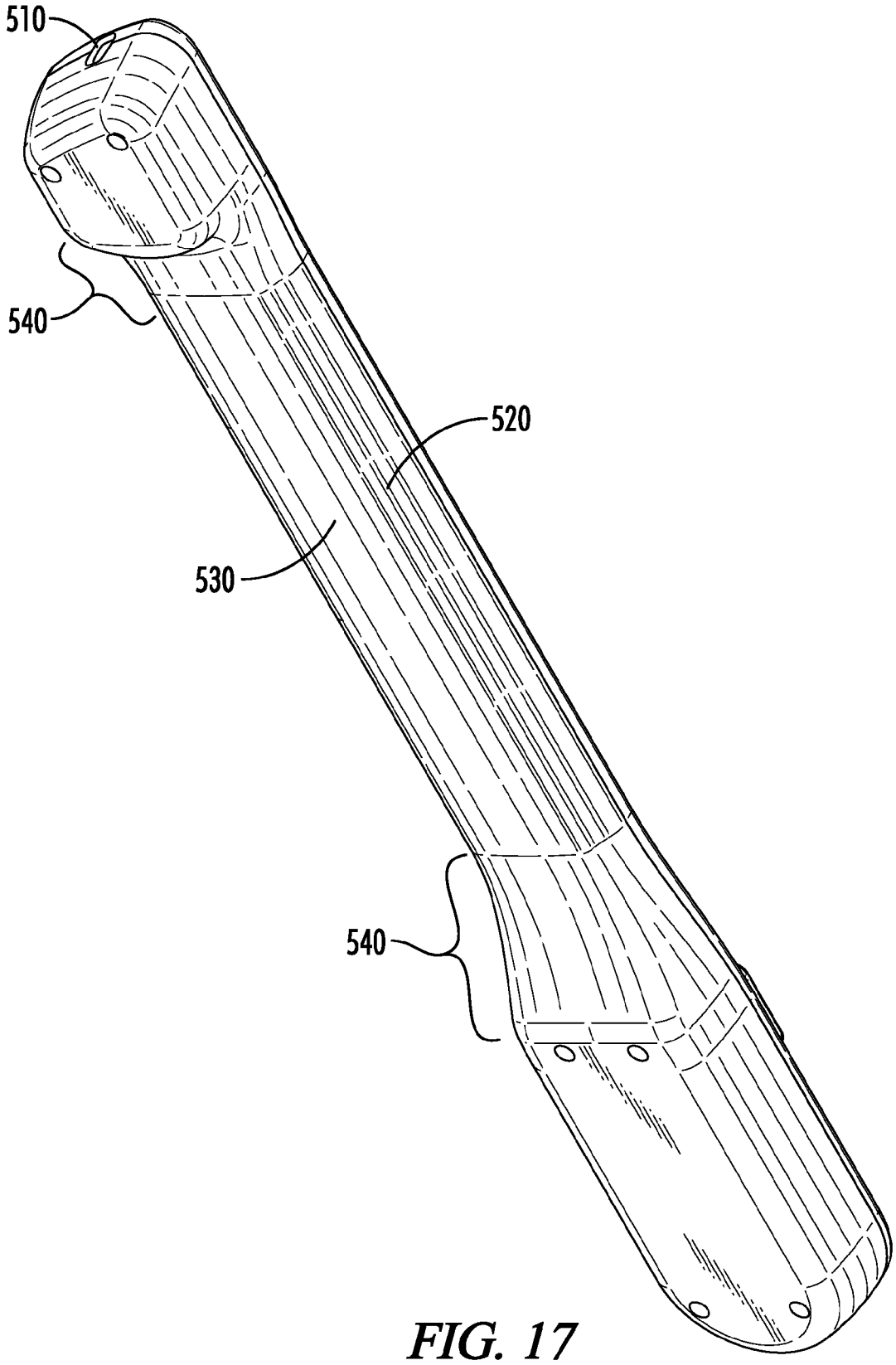
FIG. 17 is another perspective view showing an embodiment of the instrument.

As shown in FIG. 17, in one embodiment of the instrument, the back of the instrument can taper to different thicknesses 540 so that when a user plays the instrument, the user's fingers can hold the instrument similar to how a standard guitar would be held (the larger neck outline of the instrument can have a width that approximates the width of the neck of a standard guitar). The transitions on the upper and lower end of the back of the neck 540 can mimic traditional stringed instruments like the violin and guitar. This allows players to use muscle memory when feeling the limits of the fingerboard 20 with a thumb on the back of the instrument. Additionally as shown in FIG. 17, the instrument can have a neck indentation or a smaller neck outline 520 where an outside edge of the instrument tapers to a second width that is less thick or wide than the larger neck outline at the back of the instrument 530. The neck indentation 520 can approximate the neck of another or a second acoustic musical instrument (i.e., a violin). In this manner, the instrument can be held and played like a guitar while the user's thumb grips the back of the instrument 530 while accessing the fingerboard 20 on the front of the instrument with the user's fingers. Alternatively, if a user is emulating a violin, the user may place a thumb on the neck indentation 520 for a narrower feel that emulates a violin. On each side of the back of the neck, in one embodiment, these neck indentations 520 have been set along the length of the neck to allow for thumb positioning when holding the instrument like a stringed instrument. For players who are used to violin, mandolin, or other thin-necked instruments, this indentation 520 provides a familiar place to rest the thumb. Alternatively, thick-necked instrument techniques (guitar, bass) can be used by skipping this indentation and placing the finger on the back of the instrument 530. The thickness from the fingerboard 20 to the back of the instrument 530 can be roughly equivalent to the thickness of a standard guitar or bass neck. In addition to the features listed above, the back of the neck 530 can be flat in order to accommodate lap playing (like a pedal steel or keyboard). If the neck is curved like a standard stringed instrument, the instrument will wobble on the user's legs. This is possible because of the lack of string tension with the digital string-like interface, whereas convex necks are necessary for traditional stringed instruments to make sure the neck does not warp inwards.

Figure 18:
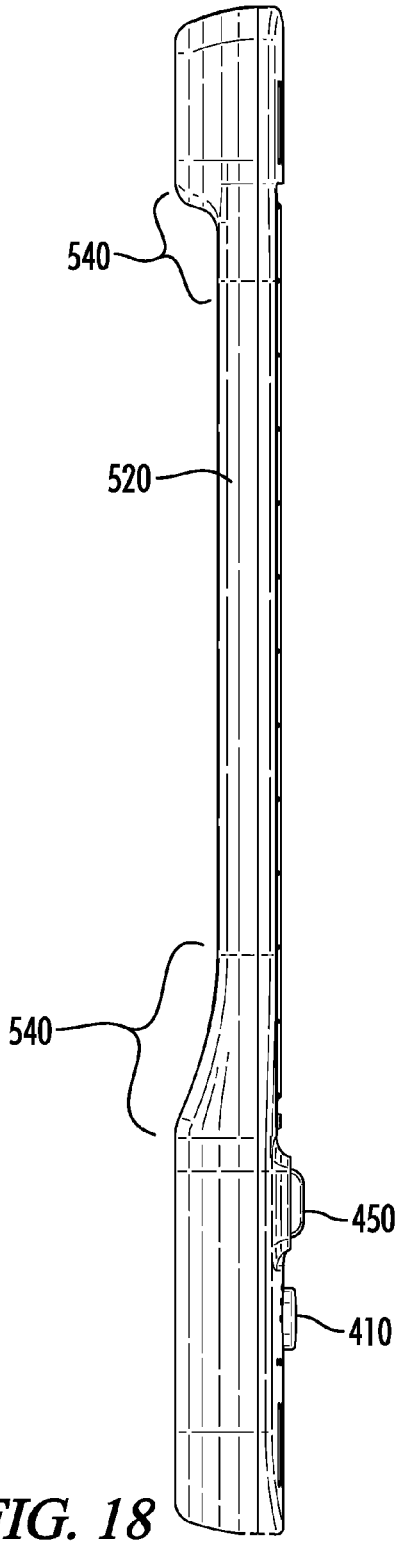
FIG. 18 is a left side view showing an embodiment of the instrument.
Figure 19:
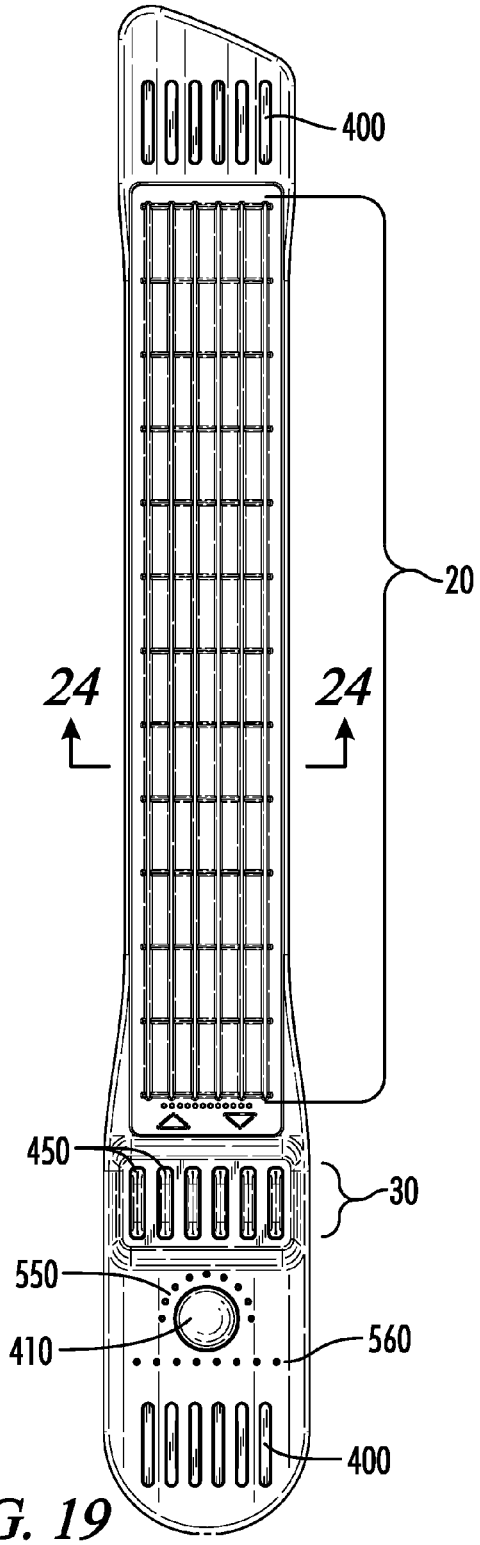
FIG. 19 is a front view showing an embodiment of the instrument.

FIG. 18 shows another view of the neck indentation 520 and tapering 540 of the instrument at 520. FIG. 18 also shows the tapered transition from the back of the neck 530 to the body of the instrument. As shown in FIG. 19, the instrument can have multiple speaker grilles 400. The instrument can also have indicators 550, for example, LED volume indicators which are placed above the knob and light with increased volume as the knob is turned. The instrument can also have preset indicators 560, for example LED indicators. These preset indicators 560 can be located in a row below the knob and allow for presets to be cycled through and indicated when the knob is pressed (or when presets are switched in a connected desktop or mobile app).

Figure 20:
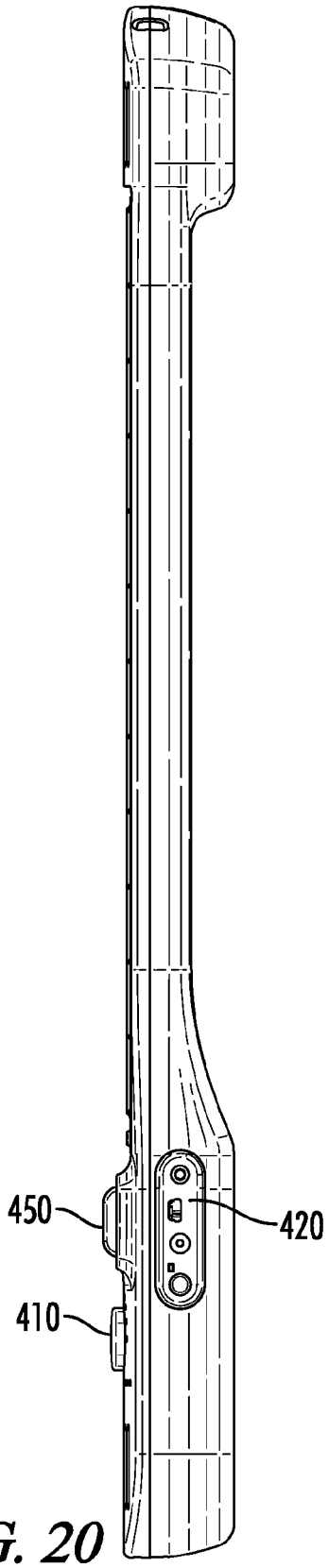
FIG. 20 is right side view showing an embodiment of the instrument.
Figure 21:
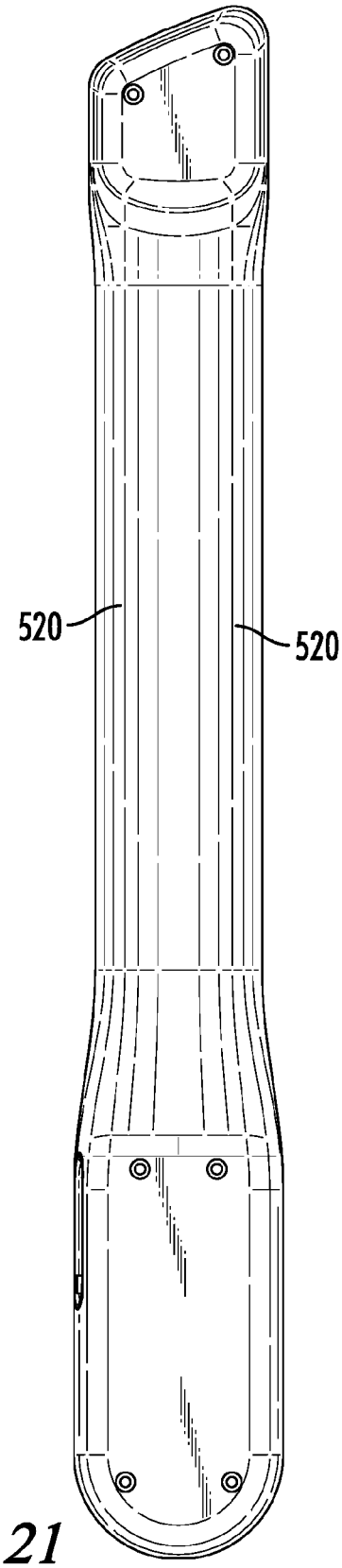
FIG. 21 is a back side view showing an embodiment of the instrument.
Figure 22:
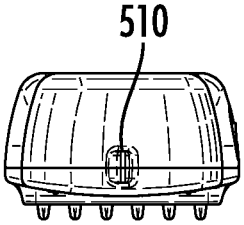
FIG. 22 is a top end view showing an embodiment of the instrument.
Figure 23:
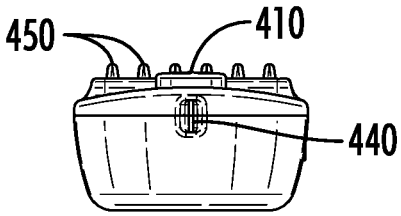
FIG. 23 is a bottom end view showing an embodiment of the instrument.
Figure 24:
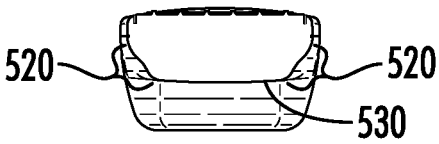
FIG. 24 is cross section of 24-24 taken from FIG. 19 showing an embodiment of the instrument.

FIG. 20 shows another view of the input/output panel 420. As shown in FIG. 21, the back view of the instrument can taper to resemble or emulate the width of one acoustic instrument while also having one or more neck indentations 520 that emulate or approximate the width of one or more different acoustic instruments as described above. As shown in FIGS. 22 and 23, a top and a bottom view of the instrument show that the profile of the instrument can be uniform to allow the instrument to be more portable than many acoustic instruments. As shown in FIG. 24, a cross-sectional view of the instrument shows neck indentations 520 and the back of the neck 530 of one embodiment which allow a user to hold the instrument in slightly different manners to approximate the feel of holding different acoustic instruments having different neck widths, as described above.

Miscellaneous

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing an invention (especially in the context of the following claims) are to be construed to cover both the singular and the plural, unless otherwise indicated herein or clearly contradicted by context. The terms "comprising," "having," "including," and "containing" are to be construed as open-ended terms (i.e., "including, but not limited to,") unless otherwise noted. Recitation of ranges as values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention (i.e., "such as, but not limited to,") unless otherwise claimed. No language in the specification should be construed as indicating any non-claimed element as essential to the practice of the invention.

Preferred embodiments of this invention are described herein. Variations of those preferred embodiments may become apparent to those having ordinary skill in the art upon reading the foregoing description. The inventors expect that skilled artisans will employ such variations as appropriate, and the inventors intend for the invention to be practiced other than as specifically described herein. Accordingly, this invention includes all modifications and equivalents of the subject matter recited in the claims appended hereto as permitted by applicable law. Moreover, any combination of the above-described elements in all possible variations hereof is encompassed by the invention unless otherwise indicated herein or otherwise clearly contradicted by context.

While the disclosure above sets forth the principles of the present invention, with the examples given for illustration only, one should realize that the use of the present invention includes all usual variations, adaptations and/or modifications, within the scope of the claims attached as well as equivalents thereof. Those skilled in the art will appreciate from the foregoing that various adaptations and modifications of the just described embodiments can be configured without departing from the scope and spirit of the invention. Therefore, it is to be understood that, within the scope of the appended claims, the invention may be practiced other than as specifically described herein.

What is claimed is:

1. A musical device comprising:

a body having a plurality of triggers and ergonomic features correlating to at least two stringed instruments that are played using different playing techniques, the ergonomic features further comprising a neck having an underside, the underside having a smaller neck outline inset from a larger neck outline, wherein the smaller neck outline provides a thumb-rest that approximates the width of violin's neck and the larger neck outline approximates the width of a guitar's neck;

a plurality of sensors;

at least one trigger that is associated with at least one of the plurality of sensors for tactile user input;

a switch to toggle the device between the at least two playing techniques, wherein each of the at least two playing techniques comprises receiving different tactile user input; and wherein the ergonomic features of the body of the device allow the user to hold the device in positions familiar to musicians of the at least two stringed instruments.

2. The device of claim 1, wherein the device simulates the sound of a variety of instruments.

3. The device of claim 2, further comprising at least one of the plurality of triggers configured to cause the musical device to bend a pitch of at least one note.

4. The device of claim 1, wherein the plurality of triggers are force and pressure sensitive.

5. The device of claim 1, wherein the function of the plurality of triggers comprises selecting, triggering or triggering and selecting a note on the device or an external peripheral.

6. The device of claim 1, wherein the plurality of triggers are string-like raised lines.

7. The device of claim 1, wherein the triggers create musical data that is translated into audio using a synthesizer.

8. The device of claim 1, wherein the plurality of triggers are divided into multiple note locations comprising multiple sensors per note location, further wherein the sensors configured to have micro-tonal sensitivity.

9. The device of claim 1, further comprising software that interpolates user input between sensors to enable note variations along a trigger.

10. The device of claim 1, wherein the plurality of triggers are tactile pseudo-strings, which allow for sightless playability.

11. A musical device comprising:

a body having a plurality of triggers and ergonomic features correlating to at least two stringed instruments that are played using different playing techniques, the ergonomic features further comprising a neck having an underside, the underside having a smaller neck outline inset from a larger neck outline, wherein the smaller neck outline provides a thumb-rest that approximates the width of violin's neck and the larger neck outline approximates the width of a guitar's neck;

a plurality of sensors;

at least one fingerboard, wherein each trigger is associated with at least one of the plurality of sensors for user input;

a switch to toggle the device between the at least two playing techniques, wherein the body is designed to be handled in ergonomic positions appropriate for each of the at least two playing techniques; and software that changes the tuning and responsiveness of the instrument based on the playing technique selected with the switch;

wherein the ergonomic features of the body of the device allow the user to play the device in positions familiar to musicians of the at least two stringed instruments.

12. The device of claim 11, wherein the device is operated using software that can change the responsiveness and data transmitted by the plurality of sensors.

13. The device of claim 11, further comprising a control panel that includes the switch to toggle the device between playing techniques.

14. The device of claim 11, wherein the device is used as a music processor for digital music data using MIDI and audio signals using an audio system.

15. The device of claim 11, further wherein the device can be played as a drum machine.

16. The device of claim 11, further comprising an accelerometer and gyroscope which measure rotation and acceleration of the device, wherein the device can detect its position and the software can automatically change the responsiveness of the instrument based on the orientation of the instrument.

17. The device of claim 11, further wherein, the device can automatically change between a left-handed or right-handed orientation based on its orientation.

* * * * *